US010385571B2

(12) United States Patent
Babcock et al.

(10) Patent No.: US 10,385,571 B2
(45) Date of Patent: Aug. 20, 2019

(54) SEAM CLIPS AND ROOF DECKING SYSTEMS UTILIZING THE SEAM CLIPS

(71) Applicant: AMERICAN BUILDINGS COMPANY, Eufaula, AL (US)

(72) Inventors: Eric Gene Babcock, Pleasant Lake, IN (US); Adam Eugene Scott, Fort Wayne, IN (US); Todd Harmon Griffin, Eufaula, AL (US); Dickson Richard Scot Macon, Eufaula, AL (US)

(73) Assignee: AMERICAN BUILDINGS COMPANY, Eufaula, AL (US)

( * ) Notice: Subject to any disclaimer, the term of this patent is extended or adjusted under 35 U.S.C. 154(b) by 0 days.

(21) Appl. No.: 15/601,228

(22) Filed: May 22, 2017

(65) Prior Publication Data

US 2017/0342714 A1 Nov. 30, 2017

Related U.S. Application Data

(60) Provisional application No. 62/340,899, filed on May 24, 2016.

(51) Int. Cl.
*E04D 3/361* (2006.01)
*E04D 3/362* (2006.01)

(52) U.S. Cl.
CPC ..... *E04D 3/362* (2013.01); *E04D 2003/3615* (2013.01)

(58) Field of Classification Search
CPC ..... E04D 3/364; E04D 3/362; E04D 3/368; E04F 13/0864
USPC ..... 52/520
See application file for complete search history.

(56) References Cited

U.S. PATENT DOCUMENTS 3,909,998 A 10/1975 Simpson et al.
3,914,916 A 10/1975 Simpson et al.
3,918,233 A 11/1975 Simpson
3,935,682 A 2/1976 Simpson
4,026,085 A 5/1977 Simpson
4,074,492 A 2/1978 Simpson et al.
4,077,171 A 3/1978 Simpson et al.
4,078,351 A 3/1978 Simpson
4,112,632 A 9/1978 Simpson
4,193,247 A * 3/1980 Heckelsberg ..... E04D 3/361 403/206
4,213,282 A * 7/1980 Heckelsberg ..... E04D 3/362 52/404.2
4,296,582 A 10/1981 Simpson et al.
4,329,823 A 5/1982 Simpson
4,351,140 A 9/1982 Simpson
4,361,993 A 12/1982 Simpson
4,366,656 A 1/1983 Simpson
4,372,014 A 2/1983 Simpson
4,375,848 A 3/1983 Simpson et al.
(Continued)

*Primary Examiner* — Paola Agudelo
(74) *Attorney, Agent, or Firm* — Moore & Van Allen PLLC; Jeffrey R. Gray

(57) ABSTRACT

Embodiments of the present invention relate to standing seam clips (e.g., panel clips and perimeter clips) that allow for improved horizontal movement of decking panels while reducing or preventing the issues associated with the binding of the standing seam clips that result in damaged roofs when the roof panels expand and contract due to temperature changes of the roof panels during heating and cooling cycles.

14 Claims, 29 Drawing Sheets

(56) References Cited

U.S. PATENT DOCUMENTS 4,403,980 A 9/1983 Simpson et al.
4,472,920 A 9/1984 Simpson
4,497,151 A 2/1985 Simpson et al.
4,503,653 A 3/1985 Simpson
4,516,371 A 5/1985 Simpson
4,520,610 A 6/1985 Simpson et al.
4,524,554 A 6/1985 Simpson
4,525,967 A 7/1985 Simpson
4,525,976 A 7/1985 Simpson
4,528,784 A 7/1985 Simpson et al.
4,528,789 A 7/1985 Simpson
4,534,148 A 8/1985 Simpson et al.
D282,627 S 2/1986 Simpson et al.
4,575,983 A * 3/1986 Lott, Jr. ..... E04D 3/363 52/520
4,597,234 A 7/1986 Simpson
4,602,468 A 7/1986 Simpson
4,620,397 A 11/1986 Simpson et al.
4,682,454 A 7/1987 Simpson et al.
4,700,522 A 10/1987 Simpson
4,796,403 A * 1/1989 Fulton ..... E04D 3/362 52/478
4,835,917 A 6/1989 Simpson
5,001,882 A * 3/1991 Watkins ..... E04D 3/362 52/478
5,005,323 A 4/1991 Simpson et al.
5,038,543 A 8/1991 Neyer
5,142,838 A 9/1992 Simpson et al.
5,222,341 A * 6/1993 Watkins ..... E04D 3/362 52/478
5,303,528 A 4/1994 Simpson et al.
5,685,118 A 11/1997 Simpson
5,692,352 A 12/1997 Simpson
5,697,197 A 12/1997 Simpson
5,704,170 A 1/1998 Simpson
5,737,894 A 4/1998 Simpson et al.
5,857,292 A 1/1999 Simpson
5,911,663 A * 6/1999 Eidson ..... E04D 3/3608 52/409
6,301,853 B1 10/2001 Simpson et al.
6,588,170 B2 7/2003 Simpson et al.
6,715,256 B1 * 4/2004 Fischer ..... E04D 3/362 52/537
6,823,642 B1 11/2004 Simpson et al.
6,889,478 B1 5/2005 Simpson
7,574,839 B1 8/2009 Simpson
7,730,694 B1 6/2010 Simpson et al.
7,874,117 B1 1/2011 Simpson
7,984,596 B1 * 7/2011 Simpson ..... E04D 3/364 52/478
8,091,312 B2 1/2012 Simpson et al.
9,834,934 B1 * 12/2017 Hodges, Jr. ..... E04D 3/364
2005/0193644 A1 9/2005 Simpson et al.
2012/0102866 A1 5/2012 Simpson et al.

* cited by examiner

SEAM CLIPS AND ROOF DECKING SYSTEMS UTILIZING THE SEAM CLIPS

CROSS REFERENCE AND PRIORITY CLAIM UNDER 35 U.S.C. § 119

The present Application for a Patent claims priority to U.S. Provisional Patent Application Ser. No. 62/340,899 entitled "Seam Clips and Roof Decking Systems Utilizing the Seam Clips" filed on May 24, 2016 and assigned to the assignees hereof and hereby expressly incorporated by reference herein.

FIELD

The present invention relates to roof decking systems and standing seam clips within the roof decking systems used to connect roofing panels to framing members of buildings. More particularly, the present invention relates to clips that provide improved sliding of a portion of the clips in the horizontal direction (otherwise described as the lateral or in plane direction) and a decking system with improved performance in variable thermal conditions.

BACKGROUND OF THE INVENTION

Buildings that utilize metal decking are typically large area, open floor steel frame buildings. The buildings typically are pre-engineered and are provided as kits of components for use in a wide range of industries, including agricultural, aircraft hangers, garages, riding arenas, indoor sports fields, warehouses, as well as commercial and governmental buildings. Steel buildings may feature open floor space, referred to as bays, and are commonly but not always, built on poured concrete slabs. Vertical columns may be operatively coupled to the concrete slabs, and extend from the concrete. The vertical columns may be operatively coupled to and support elongated rafters. Long bay purlins may be operatively coupled to the rafters in a transverse orientation to the rafters. A plurality of roof panels may be operatively coupled to the purlins with standing seam clips. The standing seam clips have a base that is operatively coupled to the purlins, and a connector that is operatively coupled to an edge of one or more roof panels. The base may be operatively coupled to the purlin or other joists with threaded fasteners or other means. The connector moves relative to the base to accommodate lateral movement of the roof in response to expansion and contraction of the roof panels due to heating and cooling. Typically the standing seam clips provide a gap between the purlin and the roof panels. Frequently the gap is filled with insulation to reduce heat transfer through the roof.

Heating and cooling cycles subject the roof to movement, which may cause the roof to buckle or become damaged over time. Some standing seam clips allow for the movement in the roof due to heating and cooling, however, some standing seam clips may bind and prevent the movement of the roof secured at the location of the standing seam clip. As such, there is a need for improved standing seam clips and roof decking systems that reduce or prevent binding of the standing seam clips, and thus, reduces or prevents damage to the roof decking panels during heating and cooling cycles.

SUMMARY OF THE INVENTION

The embodiments of the present disclosure meets the needs discussed above by providing standing seam clips that allow for improved horizontal (otherwise described as lateral or in-plane with respect to the plane of the panels and/or clips) movement while reducing or preventing the issues associated with the binding of the clips that result in damaged roofs when the roof panels expand and contract due to temperature changes of the roof panels during heating and cooling cycles. Moreover, the embodiments of the present disclosure meets the needs discussed above while maintaining or exceeding the design capacity of metal roof decking systems, including the structural strength of the clips.

Embodiments of the invention comprise a decking system with improved standing seam clips and perimeter clips for providing a roof decking system with improved thermal cycle resistance. The decking system comprising a plurality of support members, a plurality of decking panels operatively coupled to the plurality of support members, a plurality of panel clips, and a plurality of perimeter clips. Each of the plurality of decking panels comprise a male edge and a female edge opposite of the male edge.

The plurality of panel clips are operatively coupled to the one or more support members. Each of the plurality of panel clips comprise, a panel base comprising a panel base slot, at least two panel clip fasteners, a panel connector operatively coupled to the panel base through the at least two panel clip fasteners and the panel base slot, wherein the panel connector has a panel connector width, wherein the panel clip is operatively coupled with the male edge and the female edge of two of the plurality of decking panels, and wherein the panel connector is configured to slide with respect to the panel base as the at least two fasteners slide within the panel base slot.

The plurality of perimeter clips are operatively coupled to the one or more support members. Each of the plurality of perimeter clips comprise a perimeter base comprising a perimeter base slot, at least two perimeter clip fasteners, a perimeter connector operatively coupled to the perimeter base through the at least two perimeter clip fasteners and the perimeter base slot, wherein the perimeter connector has a perimeter connector width that is greater than the panel connector width, wherein the perimeter connector is operatively coupled with the male edge and the female edge of two of the plurality of decking panels, and wherein the perimeter connector is configured to slide with respect to the perimeter base within the perimeter base slot.

In further accord with embodiments of the invention, each of the plurality of panel clips further comprise first and second panel base tabs operatively coupled to the panel base, and a panel plate within the panel connector. The panel plate comprises a plate width portion, wherein the plate width portion is less than the panel connector portion, and wherein the panel connector is configured to slide with respect to the panel base until the panel plate is stopped when the plate width portion of the panel plate is stopped by the first panel base tab or the second panel base tab.

In other embodiments of the invention, each of the plurality of perimeter clips further comprises first and second perimeter base tabs operatively coupled to the perimeter base, and a perimeter plate comprising a first perimeter plate slot and a second perimeter plate slot. The first perimeter base tab is located within the first perimeter plate slot and the second perimeter base tab is located within the second perimeter plate slot. The perimeter connector is configured to slide with respect to the perimeter base as the at least two perimeter clip fasteners slide within the perimeter base slot until the perimeter plate is stopped when at least one of the first perimeter base tab is stopped by the first perimeter plate slot, or the second perimeter base tab is stopped by the second perimeter plate slot.

In still other embodiments of the inventions, the plurality of panel clips further comprise a panel clip centering device operatively coupling the panel base to the panel connector during installation, and wherein the panel clip centering device is configured to break during thermal cycling of the decking system to allow the panel connector to slide with respect to the panel base. Moreover, the plurality of perimeter clips further comprise a perimeter clip centering device operatively coupling the perimeter base to the perimeter connector during installation, and wherein the perimeter clip centering device is configured to break during thermal cycling of the decking system to allow the perimeter connector to slide with respect to the perimeter base.

In yet other embodiments of the invention, each of the plates of the plurality of panel clips and the plurality of perimeter clips comprise a plate reinforcing portion comprising a portion of the plate folded back on the plate to improve the stiffness of the plates.

In further accord with embodiments of the invention, the panel base is the same as the perimeter base.

In other embodiments of the invention, each of the bases comprise ribs to improve the strength of the bases.

In still other embodiment of the invention, the panel connector comprises at least one connector rib to improve the strength of the panel connector.

Another embodiment of the invention comprises a panel clip for use in a decking system. The panel clip comprises a panel base comprising a panel base slot, at least two panel fasteners, a panel connector operatively coupled to the panel base through the at least two panel fasteners and the panel base slot. The panel connector comprises a panel plate portion and a connector clip portion, wherein at least a portion of the panel plate has a reduced panel plate width that is less than a connector clip width. The panel clip is configured to operatively couple with a male edge and a female edge of two adjacent decking panels, and is configured to slide with respect to the panel base as the at least two panel fasteners slide within the panel base slot.

In further accord with embodiments of the invention, the panel clip further comprises first and second panel base tabs operatively coupled to the panel base. The panel connector is configured to slide until the panel plate is stopped when the panel plate portion with the reduced panel plate width is stopped by the first panel base tab or the second panel base tab.

In other embodiments of the invention, the panel clip further comprises a panel centering device operatively coupling the panel base to the panel connector, wherein the panel centering device prevents the panel connector from sliding with respect to the panel base during installation, and wherein the panel centering device is configured to break during thermal cycling of the decking system to allow the panel connector to slide with respect to the panel base.

In yet other embodiments of the invention, the panel plate of the panel connector of the panel clip comprises a plate reinforcing portion comprising a portion of the panel plate folded back on the panel plate to improve the stiffness of the panel plate of the panel connector.\

In still other embodiments of the invention, the panel base comprises at least one base rib to improve the strength of the panel base.

In further accord with embodiments of the invention, the panel connector comprises at least one connector rib to improve the strength of the panel connector.

Another embodiment of the invention comprises a perimeter clip for use in a decking system. The perimeter clip comprises a perimeter base comprising a perimeter base slot, at least two perimeter base fasteners, and a perimeter connector operatively coupled to the perimeter base through the at least two perimeter fasteners and the perimeter base slot. The perimeter connector comprises a perimeter plate with a perimeter plate width that is greater than the perimeter base width. The perimeter clip is configured to be operatively coupled with a male edge and a female edge of two adjacent decking panels. The perimeter connector is configured to slide with respect to the perimeter base as the at least two perimeter base fasteners slide within the perimeter base slot.

In further accord with embodiments of the invention, the perimeter clip further comprises a first perimeter base tab and a second perimeter base tab, both operatively coupled to the perimeter base; and a first perimeter plate slot and a second perimeter plate slot. The first perimeter base tab is located within the first perimeter plate slot and the second perimeter base tab is located within the second perimeter base tab. The perimeter connector is configured to slide with respect to the perimeter base until the perimeter plate is stopped when at least one of the first perimeter base tab is stopped by the first perimeter plate slot, or the second perimeter base tab is stopped by the second perimeter plate slot.

In other embodiments of the invention, the perimeter clip further comprises a perimeter centering device operatively coupling the perimeter base to the perimeter connector, wherein the perimeter centering device prevents the perimeter connector from sliding with respect to the perimeter base during installation, and wherein the perimeter centering device is configured to break during thermal cycling of the decking system to allow the perimeter connector to slide with respect to the perimeter base.

In still other embodiments of the invention, the perimeter plate of the perimeter connector of the perimeter clip comprises a plate reinforcing portion comprising a portion of the perimeter plate folded back on the perimeter plate to improve the stiffness of the perimeter connector.

In yet other embodiments of the invention, the perimeter base comprises at least one rib to improve the strength of the perimeter base.

In further accord with embodiments of the invention, the perimeter base comprises at least one insulation tab for operatively coupling the base to insulation within the decking system.

The features, functions, and advantages that have been discussed may be achieved independently in various embodiments of the present invention or may be combined in yet other embodiments, further details of which can be seen with reference to the following description and drawings.

BRIEF DESCRIPTION OF THE DRAWINGS

The foregoing and other advantages and features of the invention, and the manner in which the same are accomplished, will become more readily apparent upon consideration of the following detailed description of the invention taken in conjunction with the accompanying drawings, which illustrate embodiments of the invention and which are not necessarily drawn to scale, wherein.

DETAILED DESCRIPTION

Embodiments of the present invention will now be described more fully hereinafter with reference to the accompanying drawings, in which some, but not all, embodiments of the invention are shown. Indeed, the invention may be embodied in many different forms and should not be construed as limited to the embodiments set forth herein; rather, these embodiments are provided so that this disclosure will satisfy applicable legal requirements. Like numbers refer to like elements throughout.

Figure 1A:
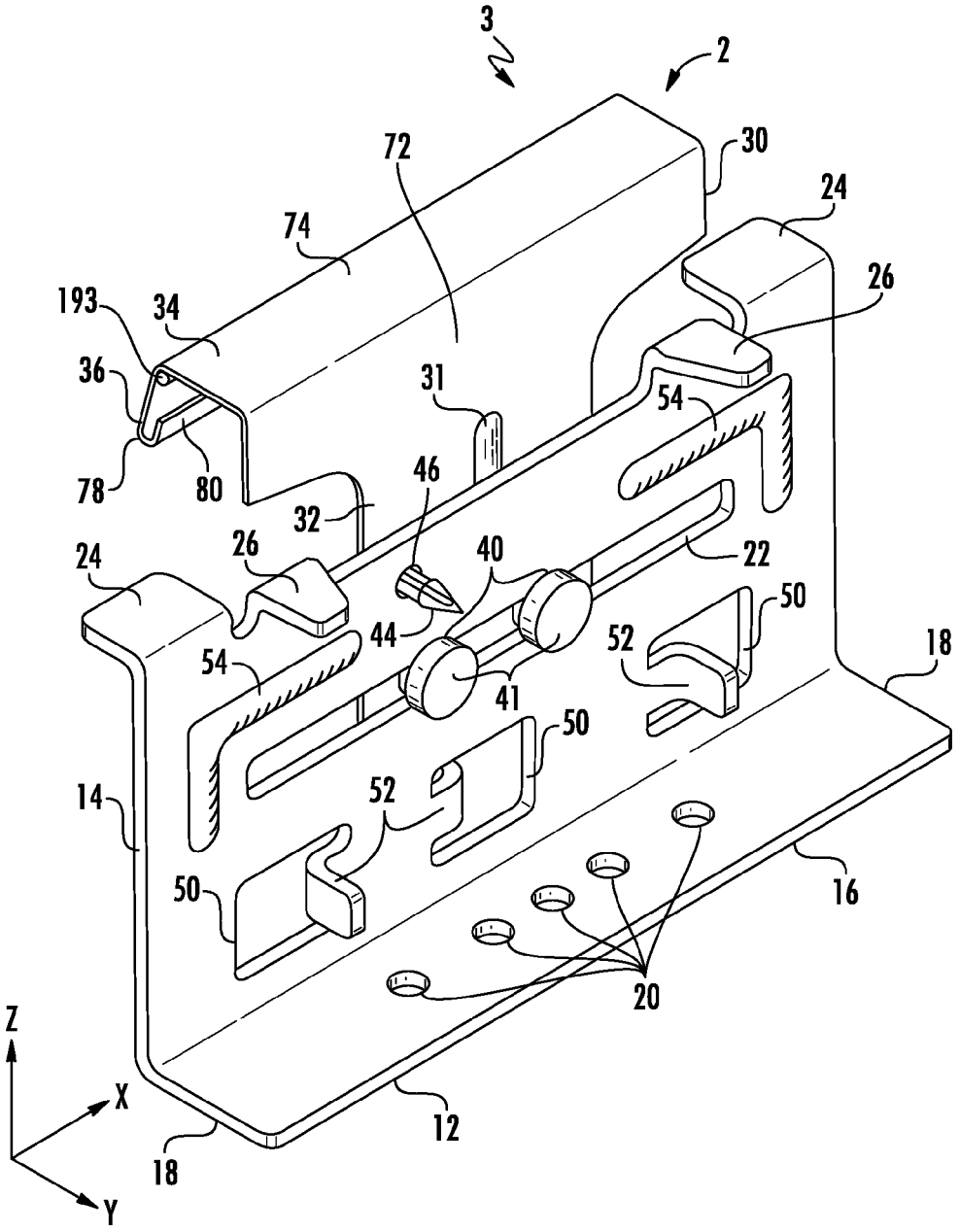
FIG. 1*a* illustrates a rear perspective view a panel clip used at the connection of the edges of two panels, in accordance with embodiments of the present disclosure.
Figure 1B:
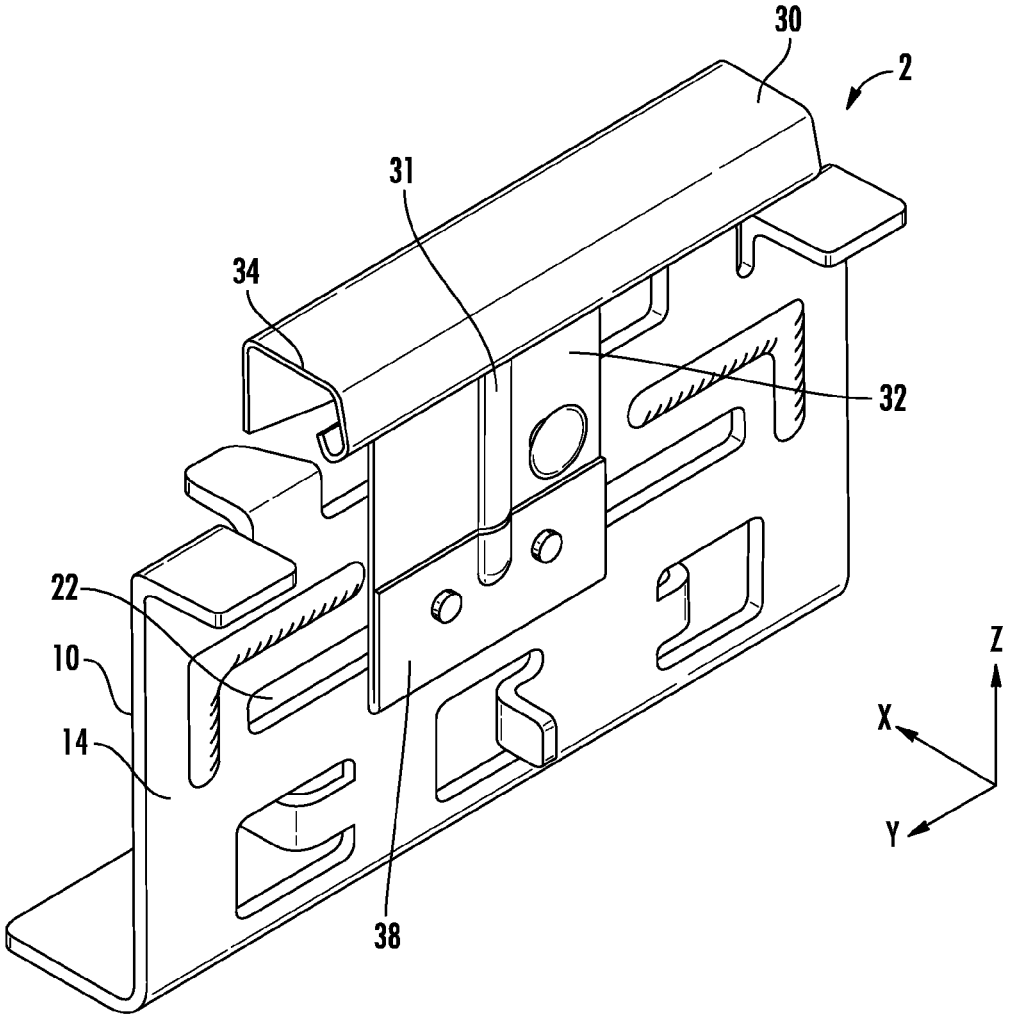
FIG. 1*b* illustrates a front perspective view a panel clip used at the connection of the edges of two panels, in accordance with embodiments of the present disclosure.
Figure 2:
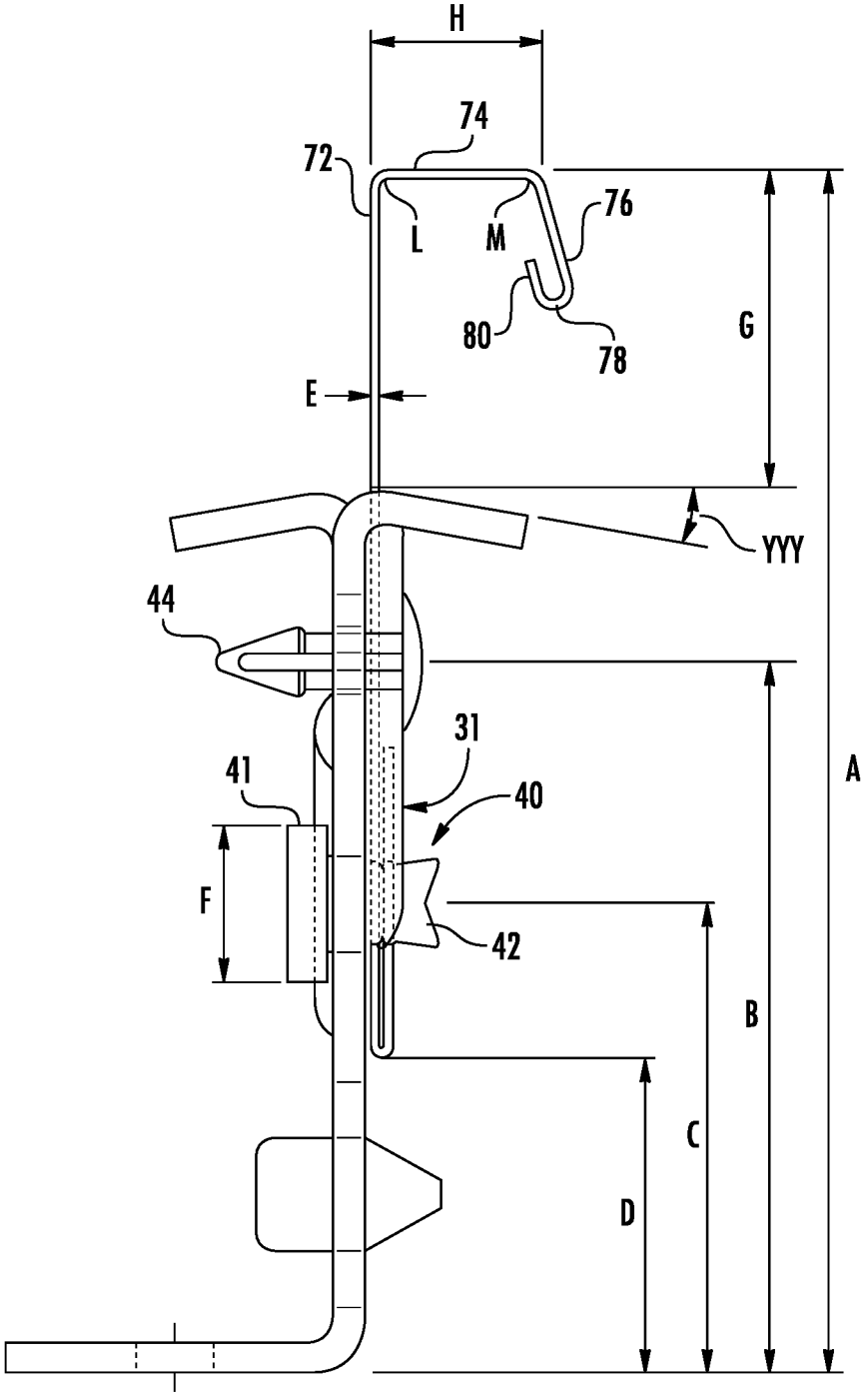
FIG. 2 illustrates a side view of the panel clip of FIG. 1, in accordance with embodiments of the present disclosure.
Figure 3:
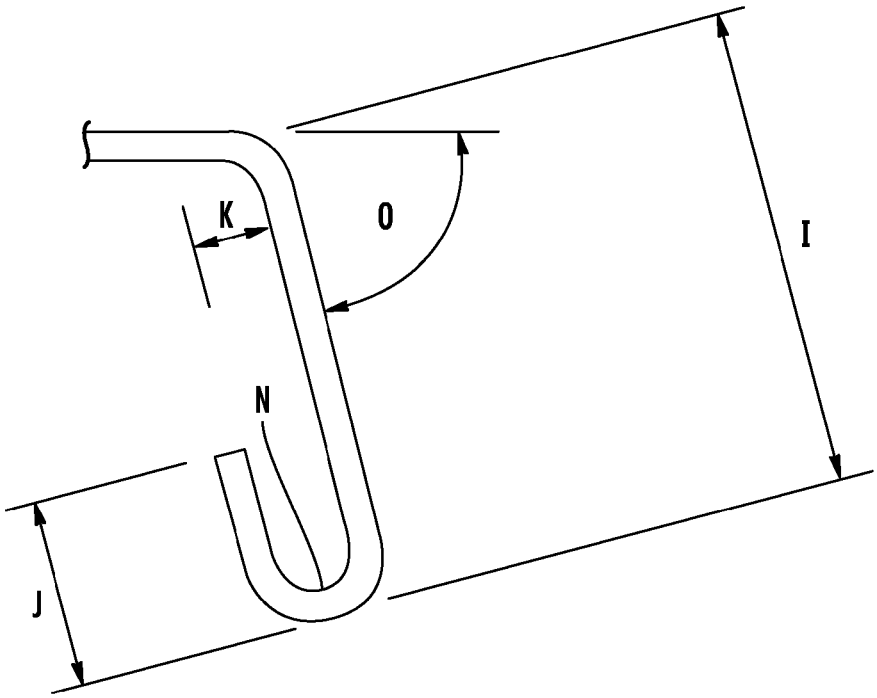
FIG. 3 illustrates an enlarged view of the hook of the connector of the panel clip of FIG. 2, in accordance with embodiments of the present disclosure.
Figure 4:
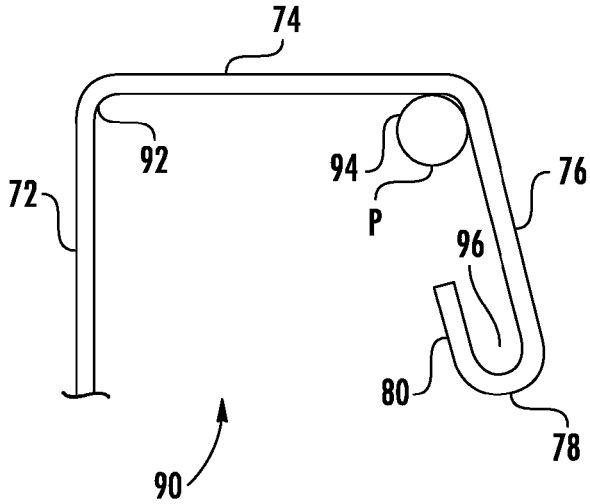
FIG. 4 illustrates an enlarged view of the connector clip portion of the connector of FIG. 2, in accordance with embodiments of the present disclosure.
Figure 5:
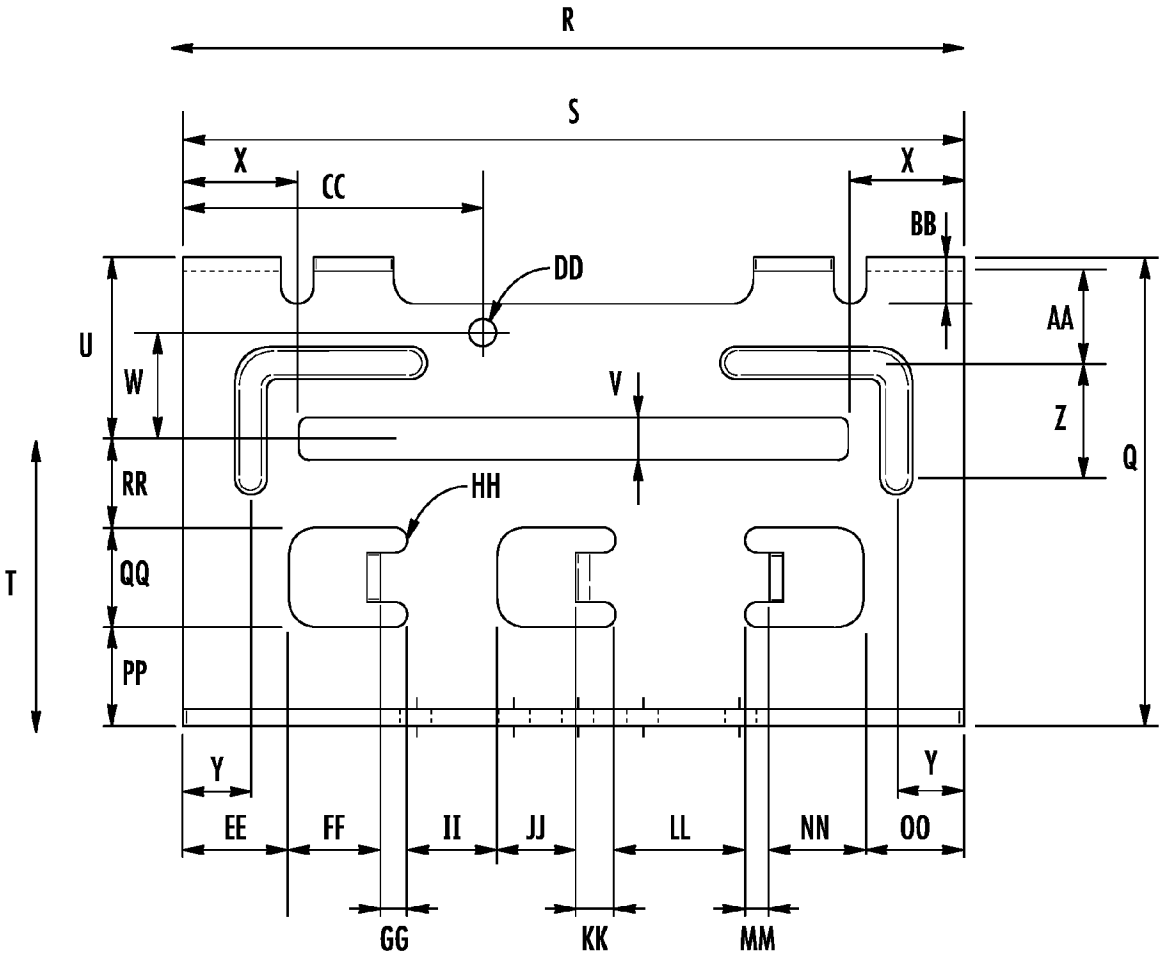
FIG. 5 illustrates a rear view of the base of the panel clip of FIG. 1, in accordance with embodiments of the present disclosure.
Figure 6:
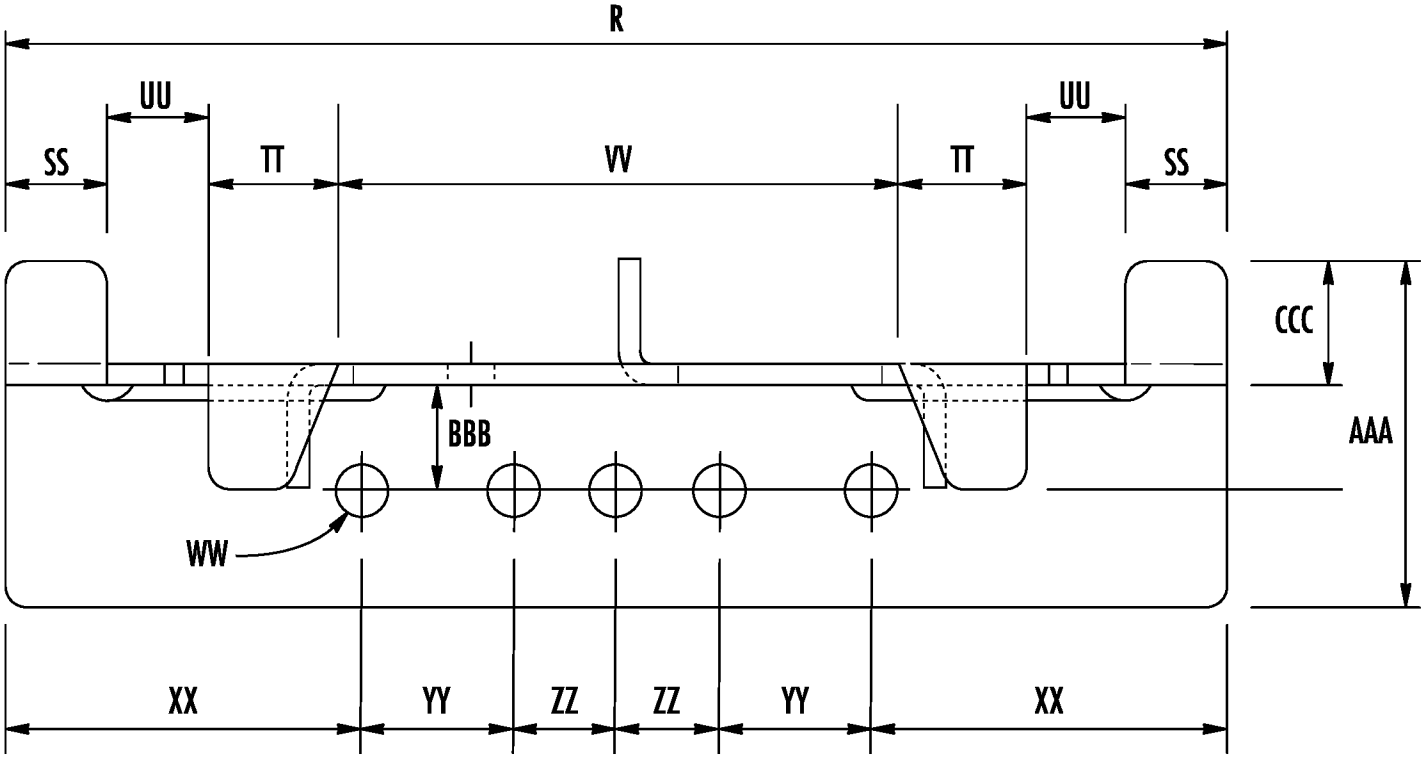
FIG. 6 illustrates a top view of the base of the panel clip of FIG. 1, in accordance with embodiments of the present disclosure.
Figure 7:
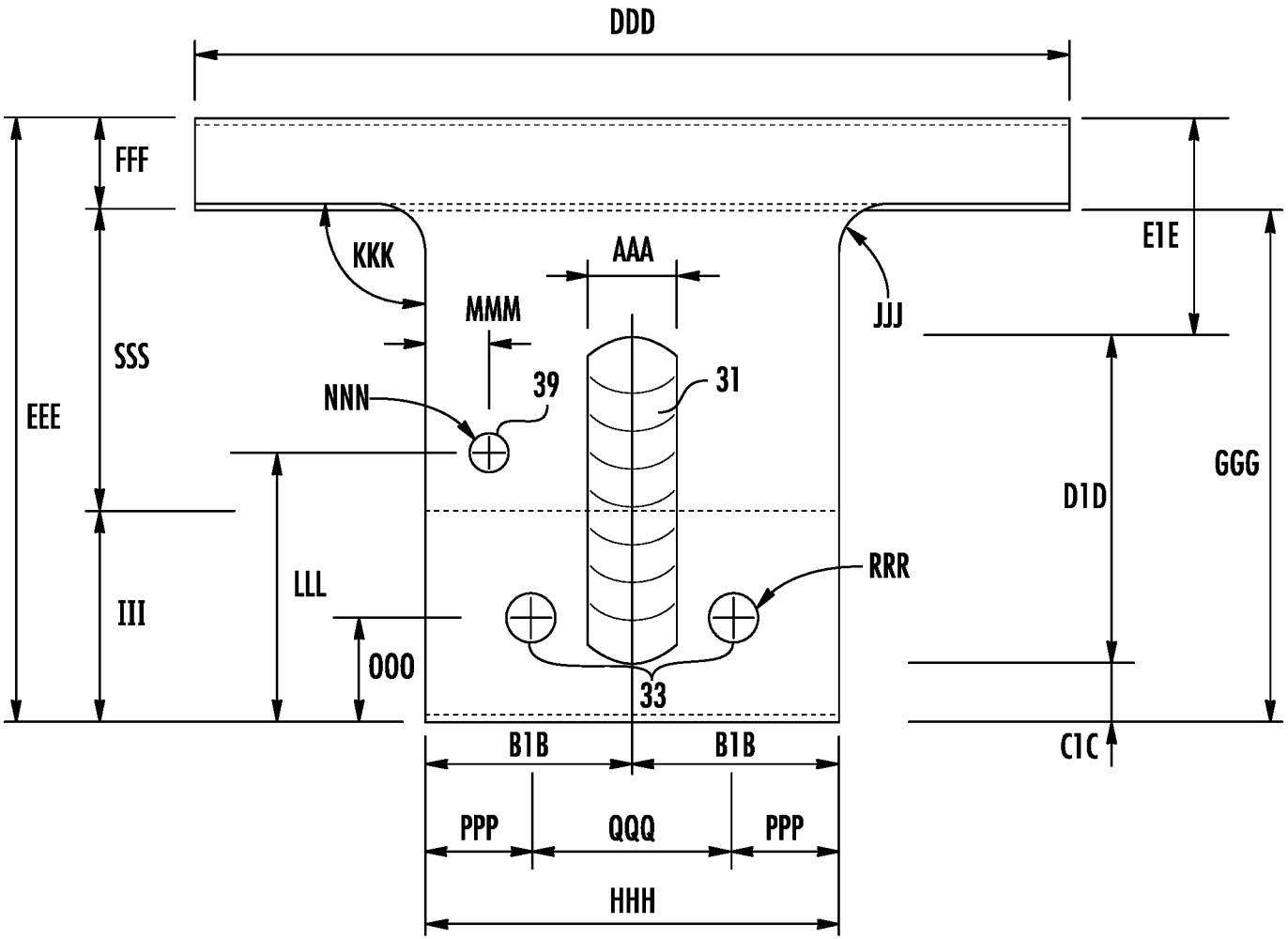
FIG. 7 illustrates a rear view of the connector of the panel clip of FIG. 1, in accordance with embodiments of the present disclosure.

FIGS. 1*a* and 1*b* illustrate rear and front perspective views of one type of a standing seam clip, described herein as a panel clip 2 (e.g., standard panel clip 3). The panel clip 2 has a base 10 (e.g., panel clip base) and a connector 30 (e.g., panel clip connector). The base 10 has a foot section 12 and a web section 14. The foot section 12 includes opposed lateral foot edges 16 and opposed end foot edges 18. In some embodiments the foot section 12 and the web section are perpendicular with each other (e.g., approximately 90 degrees), or angled with respect to each other (e.g., −45 to +45 from perpendicular). The foot section 12 defines apertures 20 that are utilized to operatively couple the foot section 12, and thus, the base 10 of the panel clip 2 to a support member, such as a purlin, joist, or the like. The apertures 20 may each receive fasteners (e.g., threaded fasteners) for securing the panel clip 2 to the support member, such as the purlin, the joist, or the like. In the illustrated embodiment, the panel clip 2 defines two pairs of spaced apart apertures 20 and a center aperture 20 (e.g., five apertures), however any number of apertures 20 may be utilized. The panel clip 2 also defines a longitudinal base slot 22 in the web section 14 of the base 10. A panel connector 30 is slidably operatively coupled to the web section 14 of the base 10. The panel connector 30 has a plate 32 and a connector clip 34 extending from the plate 32 and a hook 36 formed within the connector clip 34. In some embodiments of the invention the width of the plate 32 is less than the width of the connector clip 34 of the panel connector 30. The connector clip 34 and hook 36 are operatively coupled to edges of roof panels (e.g., described below with respect to FIGS. 14-17 and the like). The plate 32 may further include a hem 38, which includes a portion of the plate 32 folded back on the plate 32 for additional reinforcement.

The panel connector 30, and more specifically the plate 32 of the panel connector 30 may have one or more connector ribs 31. The one or more connector ribs may be any shape and pattern. As such, as illustrated in FIGS. 1*a* and 1*b*, in one embodiment, the one or more connector ribs 31 may be a single rib that extends from one end of the plate 32 to an opposite end of the plate 32. In other aspects of the invention multiple ribs 31 may extend from one end of the plate 32 to the opposite end of the plate 32. In other aspects of the invention the connector rib 31 may have an L-shape, U-shape, I-shape, S-shape, or any other like shape. In some aspects of the invention, the connector rib 31 may be formed in just the single layer of the plate 32, in just the double layer of the hem 38 of the plate 32, or in both the single layer and hem 38 of the plate 32 as illustrated in FIGS. 1*a* and 1*b*. The connector rib 31 provides improved strength to the connector 30, and allows the connector 30 portion of the panel clip 2 to support loading and slide with respect to the base 10 without the connector 30 buckling.

The web 14 of the base 10 may further comprise tabs that may be utilized to strengthen the web 14 and/or provide stops for the movement of the connector 30. In one embodiment of the invention the tabs may comprise outer top base tabs 24 and inner top base tabs 26. The web 14 of the base 10 may further comprise base insulation tabs 52, which may be utilized to operatively couple insulation (e.g., foam, expanding foam, thermos block, fiberglass, or other like insulation) under the panels 106, 108 to the panel clips 2 (or the perimeter clips 6 described later). The web 14 of the base 10 may also further comprise one or more base ribs 54 to strengthen the web 14 of the base 10. Like the connector ribs 31, the one or more base ribs 54 may be any shape and/or size, but are illustrated throughout the Figures as an L-shaped in accordance with one embodiment of the invention.

One or more fasteners 40 (e.g., rivets, pins, rods, bolts, screws, or the like), such as a pair of fasteners 40, extend through plate apertures 33 of the plate 32 of the panel connector 30 and through the base slot 22. As illustrated in FIG. 1, a flange portion 41 (e.g., head, or the like) is located or formed on a first end of the fastener 40 and extends outwardly past a portion of a slot edge of the slot 22 adjacent a web surface of the web 14. As such, a securing portion 42 (e.g., an expanded end, a nut, or another securing means) is located or formed on a second end of the fastener 40 and extends outwardly past a portion of a surface of the plate 32. In other embodiments the flange portion 41 (e.g., head, or the like) may extend outwardly adjacent a plate surface of the plate 32 of the connector 30 and the securing portion 42 of the fastener extends outwardly adjacent a web surface of the web 14. The one or more fasteners 40 slide and/or rotate within the base slot 22 such that the connector 30 moves laterally with respect to the base 10. As such, the fasteners 40 and base slot 22 guide the travel of the panel connector 30 in response to expansion and contraction of the roof panels to which the connector clip 34, and hook therein 36, is operatively coupled. In some embodiments, the panel connector 30, or panel plate 32 of the panel connector 30 will prevent further movement of the connector 30 with respect to the base 10 (e.g., prevents further sliding of the fasteners 40 within the slot 22) when an edge of the panel connector 30, or panel plate 32 of the panel connector 30, contacts a portion of the base 10, such as a base tab (e.g., at least one of the outer top base tabs 24, inner top base tabs 26, or another tab). In other embodiments, the fasteners 400 will prevent further movement of the connector 30 with respect to the base 10 when the fastener 40 contacts the edge of the base slot 22. However, in some aspects of the invention it may be beneficial for the panel connector 30 and base 10 to prevent additional sliding with respect to each other instead of the fasteners 40 contacting an edge of the base slot 22. If the fasteners 40 are allowed to contact an edge of the base slot 22 to prevent further movement between the connector 30 and the base 10, the fastener 40 may become jammed in the base slot 22, and thus prevent additional sliding.

Moreover, in some embodiments the panel clip 2 may also comprise an assembly device 44 (e.g., assembly pin, or the like), that helps to keep the panel connector 30 in position (e.g., prevent sliding laterally) with respect to the base 10 when assembling the panel clip 2 to the panels 106, 108. In some embodiments the assembly device 44 may be removed after installation of the panel clip 2, but in other embodiments the assembly device 44 may simply break off and allow for movement of the panel connector 30 with respect to the base 10 after a pre-determined force is applied to the assembly device 44 during a cooling and/or heating cycle of the roof panels 106, 108.

FIGS. 2 through 7, illustrate the features discussed above with respect to the panel clip 2, as well as some of the dimensions of the panel clip 2 described in Table 1. It should be understood that other dimensions listed in Table 1 relate to other figures, which will be described in further detail with respect to the other figures. Specific dimensions may be related to specific figures, but it should be understood that the dimensions listed in Table 1 may be related to the different types of clips discussed herein.

TABLE 1

Common Clip Dimensions Unless Noted Otherwise

| Reference Dimension | Component Name | Value (inches) | Range (inches) |
|---|---|---|---|
| A | Clip Height (FIG. 2) | 4.6035 | 3 to 6 |
| A1 | Clip Height (FIG. 9) | 3.603 | 2.5 to 4.5 |
| A2 | Clip Height Tall (FIG. 26) | 4.60 | 3 to 6 |
| | Clip Height Short (Not Illustrated) | 3.22 | 2.5 to 4.5 |
| B | Base Bottom to Centering Device (FIG. 2) | 2.9875 | 2.5 to 3.5 |
| B1 | Base Bottom to Centering Device (FIG. 9) | 1.987 | 1.5 to 2.5 |
| C | Base Bottom to Slide Fastener (FIG. 2) | 2.1875 | 1.75 to 2.5 |

TABLE 1-continued

| Common Clip Dimensions Unless Noted Otherwise | | | |
|---|---|---|---|
| Reference Dimension | Component Name | Value (inches) | Range (inches) |
| C1 | Base Bottom to Slide Fastener (FIG. 9) | 1.187 | 0.75 to 1.5 |
| D | Base Bottom to Connector Bottom (FIG. 2) | 1.6835 | 1 to 2 |
| D1 | Base Bottom to Connector Bottom (FIG. 9) | 0.683 | 0.5 to 1.0 |
| E | Connector Thickness | 0.0375 | 0.03 to 0.045 |
| F | Fastener Head Width | 0.500 | 0.3 to 0.7 |
| G | Base Top to Connector Top (First Leg) | 1.010 | 0.75 to 1.25 |
| H | Second Leg Length (FIG. 2) | 0.74 | 0.5 to 0.9 |
| H1 | Second Leg Length (FIG. 28) | 0.5910 | 0.4 to 0.8 |
| I | Third Leg Length (FIG. 2) | 0.520 | 0.3 to 0.7 |
| I1 | Third Leg Length (FIG. 28) | 0.3650 | 0.2 to 0.6 |
| J | Fifth Leg Length | 0.20 | 0.1 to 0.3 |
| K | Hook Bend Depth (Fourth Leg) | 0.08 | 0.04 to 0.1 |
| L | Connector First Bend Radius | 0.10R | 0.05R to 0.15R |
| M | Connector Second Bend Radius | 0.035R | 0.025R to 0.045R |
| N | Connector Third Bend Radius (Hook Radius) | 0.04R | 0.03R to 0.05R |
| O | Second Leg Angle | 75 Degrees | 50 to 90 Degrees |
| P | Sealant Diameter | 0.125 | 0.1 to 0.15 |
| Q | Base Height (FIG. 5) | 3.5625 | 2 to 5 |
| Q1 | Base Height (FIG. 10) | 2.562 | 2 to 3 |
| R | Base Width | 6.000 | 5 to 7 |
| S | Base Slot Length | 4.25 | 3.75 to 4.75 |
| T | Base Bottom to Base Slot Center | 2.1875 | 1.75 to 2.5 |
| U | Base Slot Center to Base Top | 1.3750 | 1 to 1.75 |
| V | Base Slot Width | 0.3125 | 0.2 to 0.5 |
| W | Slot Center to Centering Device Aperture | 0.8000 | 0.6 to 1.0 |
| X | Base Edge to Slot Edge | 0.8750 | 0.6 to 1.2 |
| Y | Base Edge to Vertical Rib Center | 0.500 | 0.4 to .06 |
| Z | Vertical Rib Length | 0.8750 | 0.6 to 1.2 |
| AA | Horizontal Rib Center to Base Top Tab | 0.7031 | 0.5 to 0.9 |
| BB | Base Top Cutout to Base Top Tab | 0.2500 | 0.15 to 0.35 |
| CC | Base Edge to Centering Device Aperture | 2.300 | 1.7 to 2.9 |
| DD | Centering Device Aperture Diameter | 0.221 | 0.1 to 0.35 |
| EE | Base Edge to First Insulation Tab Uniform Opening Edge | 0.7810 | 0.4 to 1.2 |
| FF | First Insulation Tab Uniform Opening Edge to First Insulation Tab | 0.7100 | 0.4 to 1.2 |
| GG | First Insulation Tab to First Dual Opening Edge | 0.216 | 0.1 to 0.4 |
| HH | Dual Opening Edge Radius | 0.09375R | 0.06R to 0.12R |
| II | First Insulation Tab Dual Opening Edge to Second Insulation Tab Uniform Opening Edge | 0.6830 | 0.4 to 1.2 |
| JJ | Second Insulation Tab Uniform Opening Edge to Second Insulation Tab | 0.600 | 0.4 to 1.2 |
| KK | Second Insulation Tab to Second Insulation Tab Dual Opening Edge | 0.3080 | 0.1 to 0.4 |
| LL | Second Insulation Tab Dual Opening Edge to Third Insulation Tab Dual Opening Edge | 1.0040 | 0.4 to 1.2 |
| MM | Third Insulation Tab Dual Opening Edge to Third Insulation Tab | 0.1820 | 0.1 to 0.4 |
| NN | Third Insulation Tab to Third Insulation Tab Uniform Opening Edge | 0.7380 | 0.4 to 1.2 |
| OO | Third Insulation Tab Uniform Opening Edge to Base Edge | 0.7780 | 0.4 to 1.2 |
| PP | Base Bottom to Insulation Tab Opening Bottoms | 0.7540 | 0.5 to 1.0 |
| QQ | Insulation Tab Opening Bottoms to Insulation Tab Opening Tops | 0.750 | 0.5 to 1.0 |
| RR | Insulation Tab Opening Tops to Base Slot Center | 0.6835 | 0.4 to 1.0 |
| SS | Base Top Outside Tab Widths | 0.500 | 0.1 to 1.0 |
| TT | Base Top Inside Tab Widths | 0.6250 | 0.4 to 1.0 |
| YYY | Tab Angle from Horizontal Plane | 10 degrees | 0 to 60 degrees |
| UU | Space Between Outside Tab and Inside Tab | 0.500 | 0.1 to 0.75 |
| VV | Space Between Inside Tabs | 2.750 | 2 to 3.5 |
| WW | Foot Aperture Diameters | 0.250 | 0.1 to 0.4 |
| XX | Base Foot Edge to Outer Foot Apertures | 1.750 | 1 to 2.5 |
| YY | Outer Foot Apertures to Inner Foot Apertures | 0.750 | 0.25 to 1.25 |
| ZZ | Distance Between Inner Foot Apertures to Center Hole | 0.500 | 0.25 to 0.75 |
| AAA | Base Depth | 1.6977 | 1 to 2.5 |
| BBB | Inner Tab Depth | 0.5102 | 0.2 to 0.8 |

TABLE 1-continued

| Common Clip Dimensions Unless Noted Otherwise | | | |
|---|---|---|---|
| Reference Dimension | Component Name | Value (inches) | Range (inches) |
| CCC | Outer Tab Depth | 0.6148 | 0.2 to 0.8 |
| DDD | Connector Width (FIG. 7) | 4.250 | 3 to 5 |
| DDD1 | Connector Width (FIGS. 13 and 27) | 12.00 | 6 to 18 |
| EEE | Connector Height | 2.920 | 2 to 4 |
| FFF | Connector Clip Height (FIG. 7) | 0.4419 | 0.3 to 0.6 |
| FFF1 | Connector Clip Height (FIGS. 13 and 27) | 0.420 | 0.3 to 0.6 |
| GGG | Plate Height (FIG. 7) | 2.4781 | 1.5 to 3.5 |
| GGG1 | Plate Height (FIGS. 13 and 27) | 2.500 | 1.5 to 3.5 |
| HHH | Plate Width | 2.000 | 1 to 3 |
| III | Hem Height | 1.020 | 0.5 to 1.5 |
| JJJ | Connector Clip to Plate Radius | 0.3750 | 0.3 to 0.5 |
| KKK | Connector Clip to Plate Angle | 90 Degrees | 80 to 110 Degrees |
| LLL | Plate Bottom to Centering Device Plate Aperture | 1.3040 | 0.8 to 1.8 |
| MMM | Plate Edge to Centering Device Plate Aperture | 0.300 | 0.1 to 0.6 |
| NNN | Centering Device Plate Aperture Diameter | 0.1870 | 0.1 to 0.3 |
| OOO | Plate Bottom to Connector Fastener Aperture | 0.5040 | 0.25 to 0.75 |
| PPP | Plate Edge to Connector Fastener Aperture (FIG. 7) | 0.5000 | 0.25 to 0.75 |
| PPP1 | Plate Edge to Connector Fastener Aperture (FIGS. 13 and 27) | 5.500 | 2.50 to 8.50 |
| QQQ | Distance Between Connector Fastener Apertures | 1.000 | 0.5 to 1.5 |
| RRR | Connector Fastener Aperture Diameter | 0.257 | 0.15 to 0.35 |
| SSS | Hem Top to Connector Clip (FIG. 7) | 1.4581 | 1.0 to 2.0 |
| SSS1 | Hem to Connector Clip (FIGS. 13 and 27) | 1.48 | 1.0 to 2.0 |
| TTT | Connector Slot Top to Connector Top (FIGS. 13 and 27) | 1.000 | 0.5 to 1.5 |
| UUU | Connector Slot Width | 3.25 | 2.25 to 4.25 |
| VVV | Connector Slot Height (FIGS. 13 and 27) | 0.38 | 0.1 to 0.5 |
| WWW | Connector Edge to Connector Slot Edge (FIGS. 13 and 27) | 1.75 | 0.25 to 2.25 |
| XXX | Distance Between Connector Slots (FIGS. 13 and 27) | 2.00 | 1 to 3 |
| AAAA | First Cavity Radius (FIGS. 28) | 0.0970 (FIG. 28) | 0.05 to 0.15 |
| BBBB | First Cavity Angle (FIGS. 28) | 60 degrees (FIG. 28) | 50 to 80 degrees |
| CCCC | Second Cavity Radius (FIGS. 28) | 0.0610 (FIG. 28) | 0.03 to 0.09 |
| DDDD | Second Cavity Angle (FIGS. 28) | 45 degrees (FIG. 28) | 15 to 75 degrees |
| A1A | Connector Clip Stiffening Rib | .42 | .31 to .63 |
| B1B | Stiffening Rib Dimension | 1.00 | .75-1.50 |
| C1C | Stiffening Rib Location (From Bottom) | .28 | .125-.500 |
| D1D | Stiffening Rib Length | 1.588 | 1.25-1.75 |
| E1E | Stiffening Rib Location (From Top) | 1.00 | .75-1.50 |

It should be understood that the values and ranges of the dimensions described in Table 1, may include other values or other ranges that may be within the stated ranges, outside of the stated ranges, or overlapping the stated ranges. As such, the panel clip 2 (or other clips described herein) may have different dimension values or ranges than what is illustrated in Table 1 and the Figures illustrated herein. Moreover, the ranges described herein are inclusive of the end values in the ranges.

Figure 8:
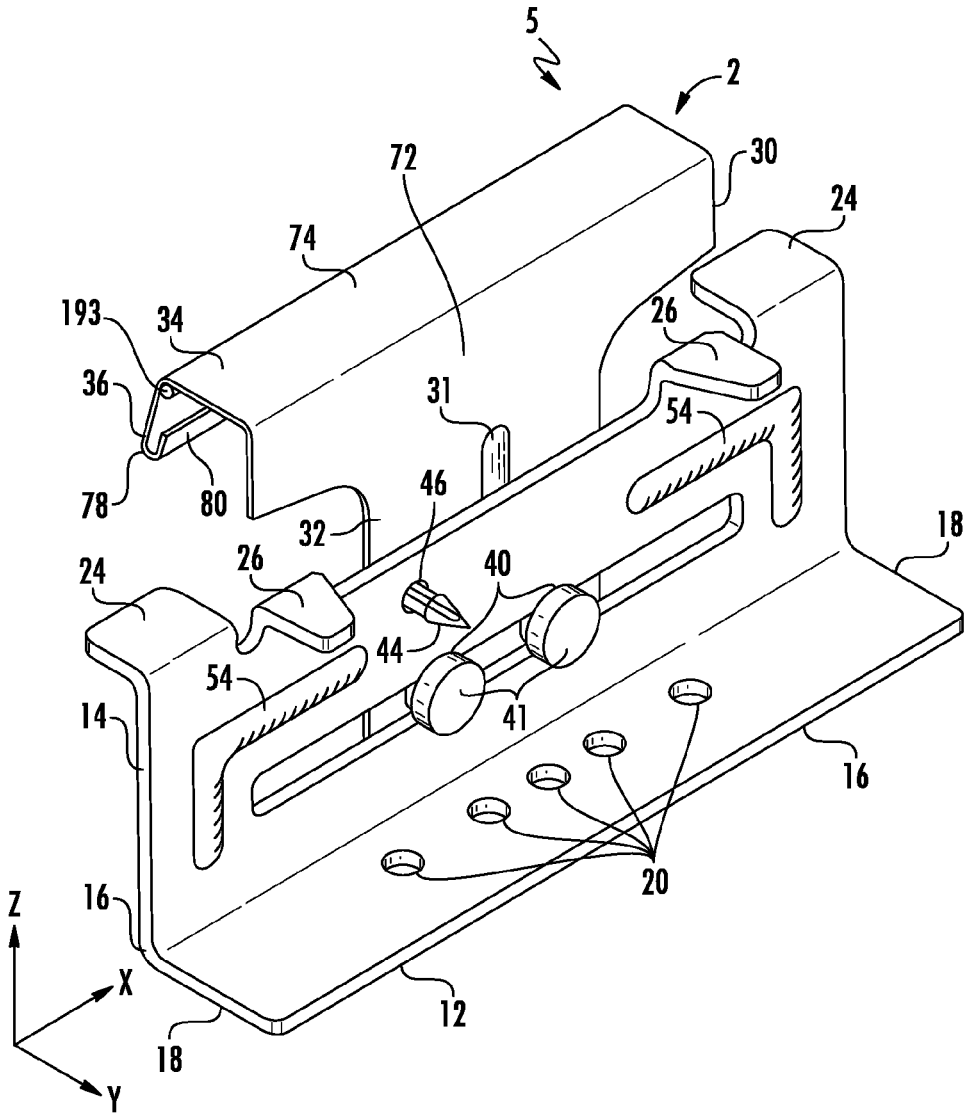
FIG. 8 illustrates a perspective view a panel clip used at the connection of the edges of two panels, in accordance with embodiments of the present disclosure.
Figure 9:
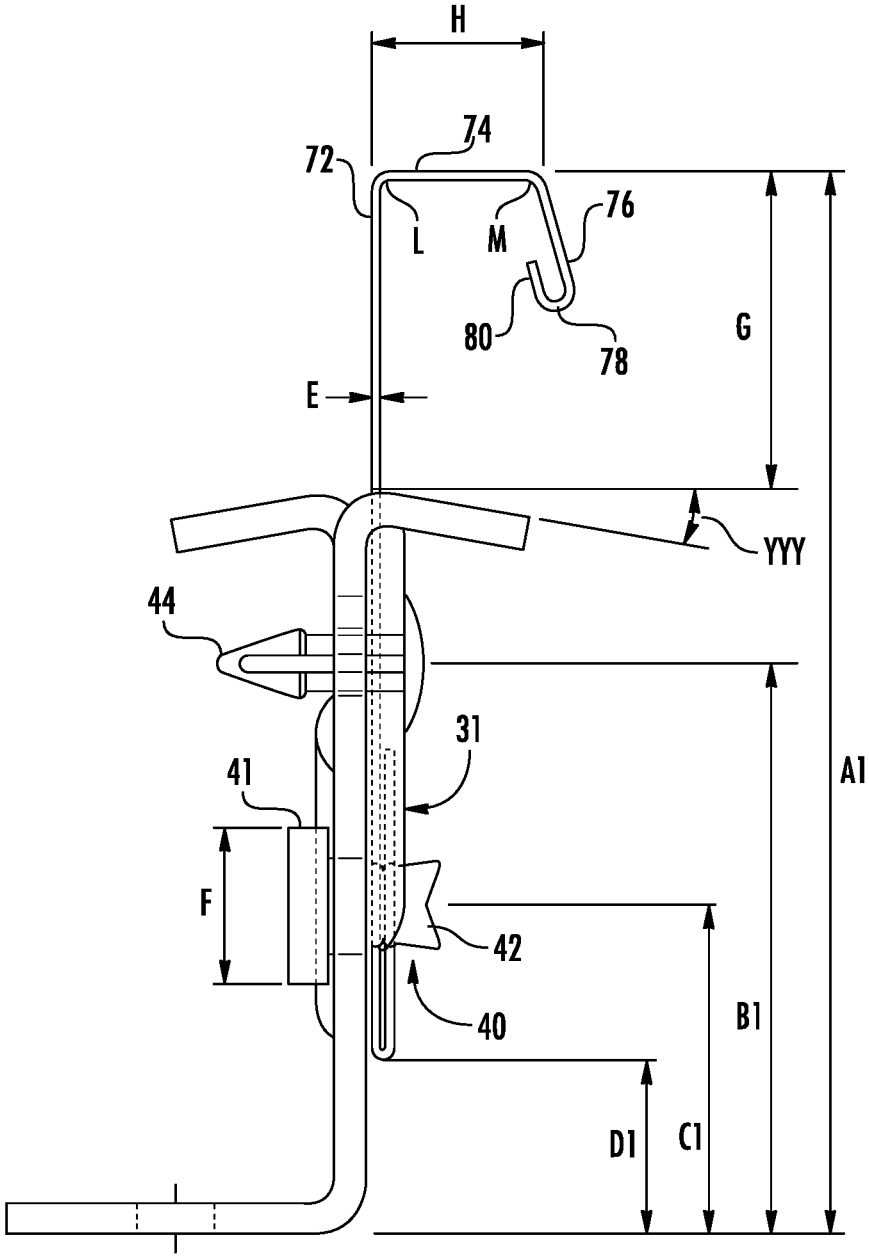
FIG. 9 illustrates a side view of the panel clip of FIG. 8, in accordance with embodiments of the present disclosure.
Figure 10:
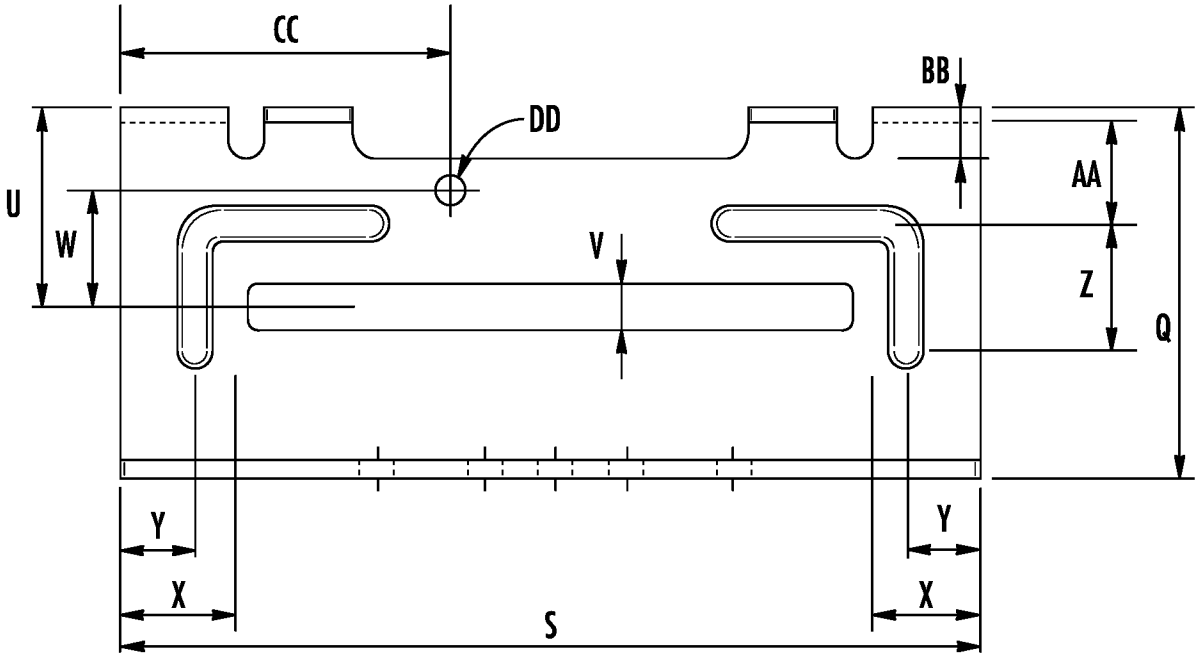
FIG. 10 illustrates a rear view of the base of the panel clip of FIG. 8, in accordance with embodiments of the present disclosure.

FIGS. 8 through 10 illustrate another embodiment of the panel clip 2 in which the height of the web 14 is reduced (e.g., short clip 5) when compared to the panel clip 2 illustrated in FIGS. 1 through 7 (e.g., standard clip 3). The panel clip 2 with the reduced web height may be utilized in situations for sloping a roof (e.g., when used in combination with standard panel clip), in areas where the distance between the panels 106, 108 and the support member 102 is reduced, or the like. The short panel clip 5 with the reduced web 14 has many of the same dimensions and features as the standard panel clip 3; however, it does not include the base tab openings 50 or the base tabs 52 included in the standard panel clip 3. The dimensions of the short panel clip 5 that are different from the standard panel clip 3 are illustrated in Table 1 and FIGS. 8-10.

Other embodiments of the panel clip 2 may include clips in which the height of the web 14 is further reduced (e.g., zero offset panel clip not illustrated in the Figures) when compared to the panel clip 2 illustrated in FIGS. 1-7 (e.g., standard clip 3) or FIGS. 8-10. The panel clip 2 with the reduced web height (e.g., zero offset panel clip) may also be utilized in situations for sloping a roof (e.g., when used in combination with standard panel clip 3, short panel clip 5, or the like), in areas where the distance between the panels 106, 108 and the support member 102 is decreased, or the like. The zero offset panel clip with the decreased web height has many of the same dimensions and features as the standard panel clip 3; however, it does not include the base tap openings 50 or the base tabs 52 included in the standard panel clip 3 and the web height is shorter than both the standard panel clip 3 and the short panel clip 3. In some embodiments, the dimensions of the zero offset clip may have a clip height A equal to 3.1 inches or a range of 2 to 4 inches. Moreover, the zero offset clip may have a connector 30, for which the bottom edge of the plate 32 or hem 38 aligns with the foot 12 of the base 10 (e.g., zero offset).

Other embodiments of the panel clip 2 may include clips in which the height of the web 14 is increased (e.g., tall panel clip not illustrated in the Figures) when compared to the panel clip 2 illustrated in FIGS. 1-7 (e.g., standard clip 3). The panel clip 2 with the increased web height may also be utilized in situations for sloping a roof (e.g., when used in combination with standard panel clip 3, short panel clip 5, or the like), in areas where the distance between the panels 106, 108 and the support member 102 is increased, or the like. The tall panel clip with the increased web height has many of the same dimensions and features as the standard panel clip 3. In some embodiments, the dimensions of the tall clip may have a clip height A equal to 5.1 inches or a range of 4 to 6 inches.

Figure 11:
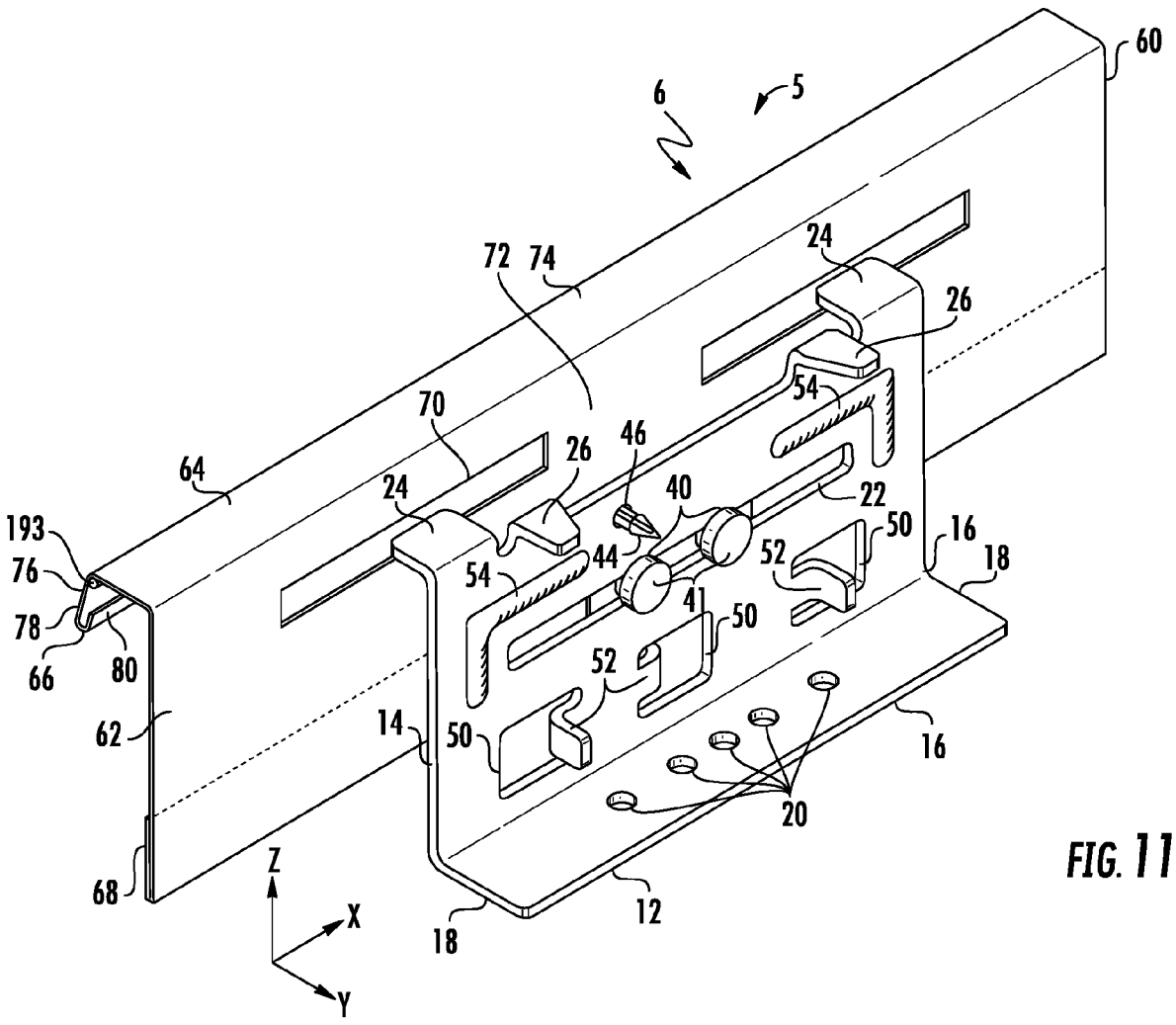
FIG. 11 illustrates a perspective view a perimeter clip used between the edges of adjacent panels, in accordance with embodiments of the present disclosure.

FIG. 11 illustrates a perspective view of a different type of clip used in roof assemblies, such as a perimeter clip 6 (e.g., standard perimeter clip 7). The perimeter clip 6, like the panel clip 2, has a perimeter base 10 and a perimeter connector 60. In some embodiments, as illustrated in FIG. 11, the perimeter clip base 10 is the same as the panel clip base 10 previously described with respect to FIGS. 1-7 for the panel clip 2 (e.g., standard clip 3), but the perimeter connector 60 of the perimeter clip 6 is different than the panel connector 30 of the panel clip 2. The perimeter connector 60 slidably attaches to the web section 14 of the perimeter base 10. The perimeter connector 60 has a perimeter plate 62 and a connector clip 64 extending from the perimeter plate 62 and a hook 66 within the connector clip 64. The perimeter clip 6 may be operatively coupled to specific locations of the roof panels, such as near the perimeter of the roof systems which is described in further detail with respect to FIG. 30. However, it should be understood that where additional strength is needed in the roof assembly (e.g., in areas of greater uplift force) the perimeter clip 6 may be utilized anywhere in the roof assembly, and/or throughout the entire roof.

One or more fasteners 40 (e.g., rivets, pins, rods, bolts, screws, or the like), such as a pair of fasteners 40, extend through plate apertures 63 of the perimeter plate 62 and through the base slot 22. As illustrated in FIG. 11, a flange portion 41 (e.g., head, or the like) is located or formed on a first end of the fastener 40 and extends outwardly past a portion of a slot edge of the slot 22 adjacent a web surface of the web 14 of the perimeter base 10. As such, a securing portion 42 (e.g., an expanded end, a nut, or another securing means) is located or formed on a second end of the fastener 40 and extends outwardly past a portion of a surface of the perimeter plate 62 of the perimeter connector 60. In other embodiments the flange portion 41 (e.g., head, or the like) may extend outwardly adjacent a plate surface of the perimeter plate 62 of the perimeter connector 60 and the securing portion 42 of the fastener extends outwardly adjacent a web surface of the web 14. The one or more fasteners 40 slide and/or rotate within the base slot 22 such that the perimeter connector 60 moves laterally with respect to the perimeter base 10. As such, the one or more fasteners 40 and slot 22 guide the travel of the perimeter connector 60 in response to expansion and contraction of the roof panels to which the connector clip 64, and hook 66 therein, are operatively coupled. In some embodiments, the perimeter plate 62 of the perimeter connector 60 has one or more perimeter connector slots 70 (e.g., two slots in the illustrated embodiment) through which one or more base tabs (e.g., the base outer top tabs 24, the base inner top tabs 26, or the like) are located. As such, the one or more perimeter connector slots 70 may prevent further movement of the perimeter connector 60 with respect to the base 10 (e.g., further sliding of the fasteners 40 within the slot 22) when an edge of the one or more perimeter connector slots 70 contacts the base tabs (e.g., the base outer top tab 24, or the like). As previously described with respect to the panel clip 2, in some aspects of the invention it may be beneficial for the perimeter connector 60, 160 and base 10 (e.g., tabs) to prevent additional sliding with respect to each other instead of the fasteners 40 contacting an edge of the base slot 22. If the fasteners 40 are allowed to contact an edge of the base slot 22 to prevent further movement between the perimeter connector 60, 160 and the base 10, the fastener 40 may become jammed in the base slot 22, and thus prevent additional sliding.

Moreover, in some embodiments the perimeter clip 6 may also comprise an assembly device 44 (e.g., assembly pin, or the like), that helps to keep the perimeter connector 60 in position (e.g., prevent sliding) with respect to the perimeter base 10 when assembling the perimeter clip 6 to the panels 106, 108. In some embodiments the assembly device 44 may be removed after installation of the perimeter clip 6, but in other embodiments the assembly device 44 may simply break and allow for movement of the perimeter connector 60 with respect to the perimeter base 10 after a pre-determined force is applied to the assembly device 44 during a cooling and/or heating cycle of the roof panels 106, 108.

Stiffening ribs are typically not needed in the perimeter clip 6 because of the width of the perimeter connector 60, 160; however, the perimeter clip 6 could have stiffening ribs in some aspects of the invention to improve the strength of the perimeter connector 60, 160, if needed.

Figure 12:
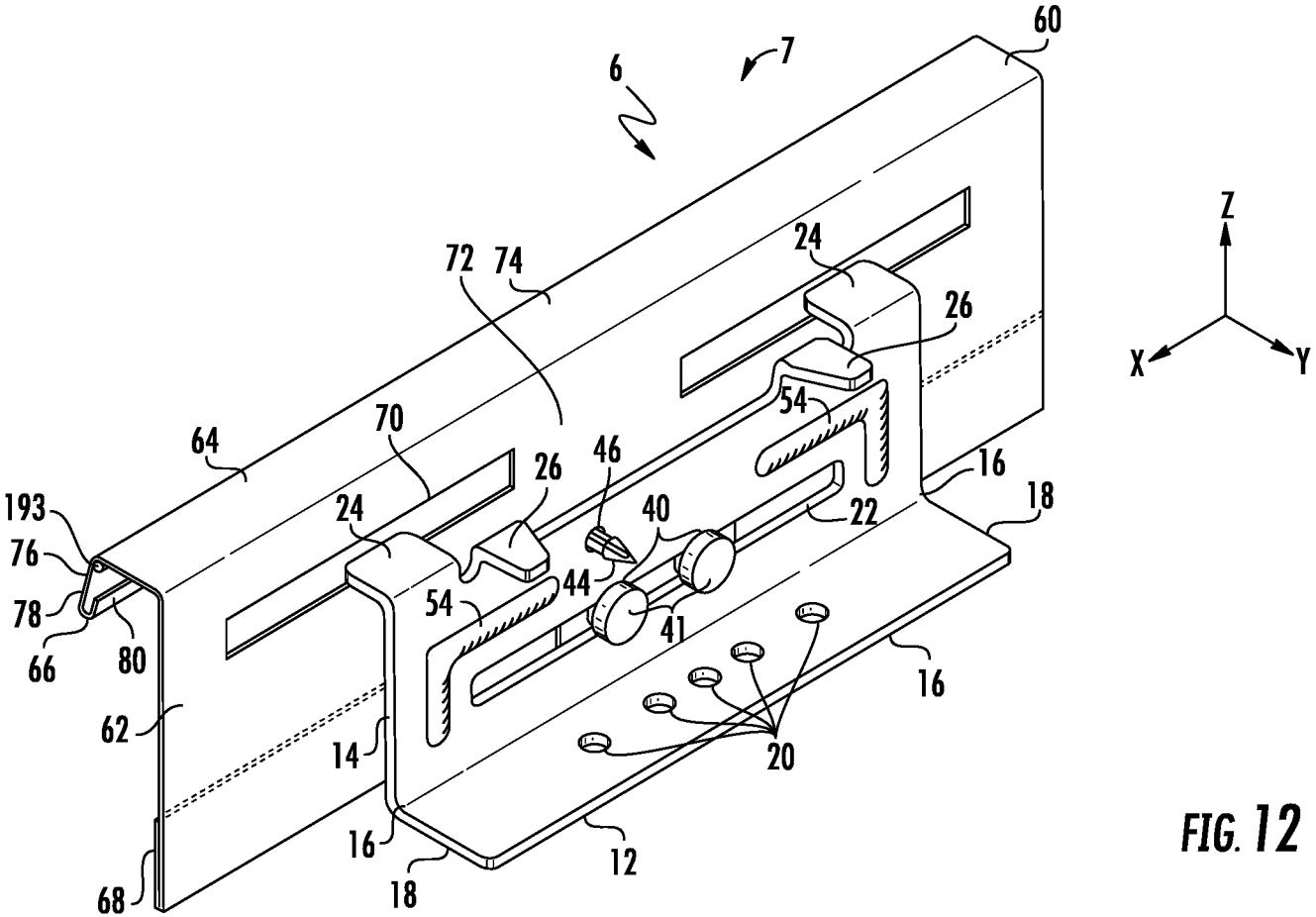
FIG. 12 illustrates a perspective view a perimeter clip used between the edges of adjacent panels, in accordance with embodiments of the present disclosure.

FIG. 12 illustrates another embodiment of the perimeter clip 6 in which the height of the web 14 is reduced (e.g., short perimeter clip 9) when compared to the perimeter clip 6 illustrated in FIG. 11 (e.g., standard perimeter clip 7). The perimeter clip 6 with the reduced web height may be utilized in situations for sloping a roof (e.g., when used in combination with the other clips discussed herein), in areas where the distance between the panels 106, 108 and the support member 102 is reduced, or the like. The short perimeter clip 9 with the reduced web 14 has many of the same dimensions and features as the standard perimeter clip 7; however, it does not include the base tab openings 50 or the base tabs 52 included in the standard perimeter clip 7 or the standard panel clip 3. In some embodiments, the dimensions of the short perimeter clip 9 are only different from the standard perimeter clip 7 as previously described with the difference in the bases 10 of the standard panel clip 3 and the short panel clip 5. It should be further understood that the perimeter clip 6 may include a zero offset perimeter clip and/or a tall perimeter clip 6, however only the perimeter clip base 10 changes and not the perimeter connector 60, as previously discussed with respect to the panel clip 2.

Figure 13:
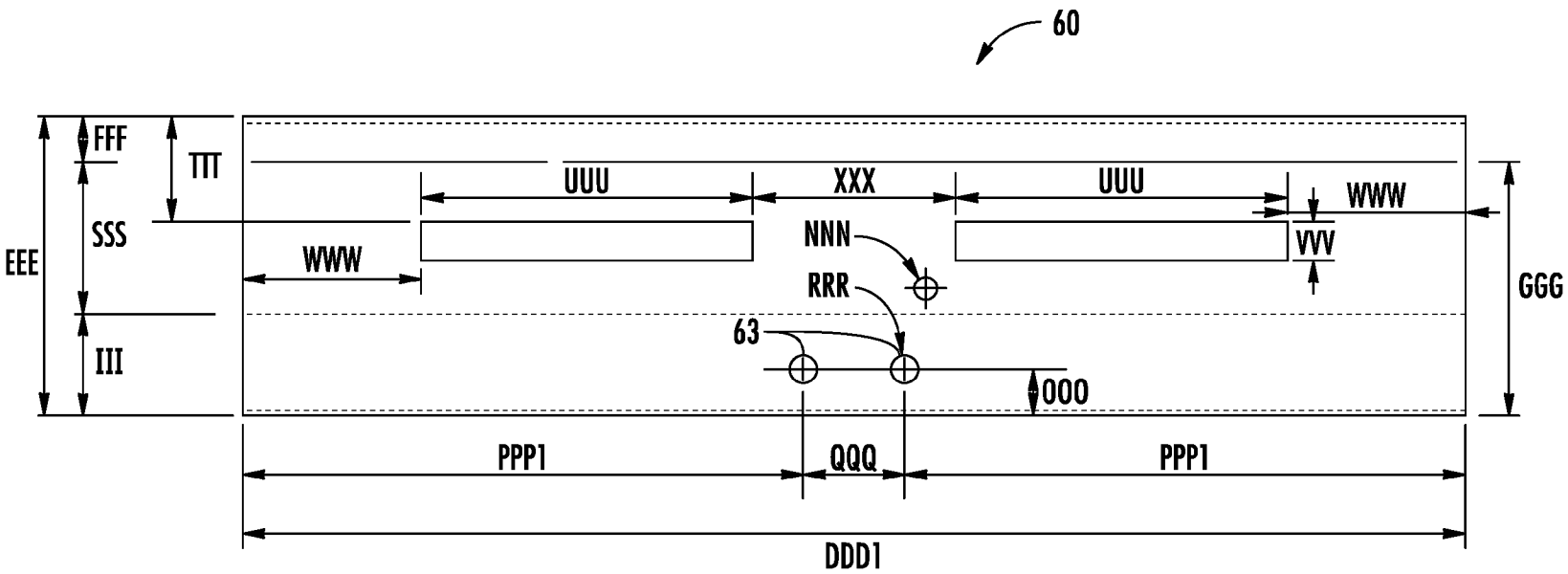
FIG. 13 illustrates a front view of the connector of the perimeter clips of FIGS. 11 and 12, in accordance with embodiments of the present disclosure.

FIG. 13, illustrates the features discussed above with respect to the perimeter clip 2, as well as the dimensions of the perimeter clip 6 described in Table 1.

The connectors 30, 60, 160 (160 is described in further detail with respect to FIGS. 26-28) may have any type of configuration that allows the connectors 30, 60 to be operatively coupled to the edges of adjacent roof decking panels.

However, in one embodiment, as illustrated by FIGS. 1-13, the connectors 30, 60 may have a connector first leg 72 that extends from, or is otherwise integral with), the plates 32, 62, which extends generally vertically with respect to the clips 2, 6 (e.g., in the x-z plane), such as approximately 90 degrees from a horizontal plane (e.g., the x-y plane) of the clips 2, 6, or in other embodiments between 60 and 120 degrees, or another value or range of values within, outside, or overlapping this range. A connector second leg 74 extends generally horizontally from the connector first leg 72, such as approximately 0 degrees from a horizontal plane (e.g., the x-y plane) of the clip 2, 6, or in other embodiments between −45 and +45 degrees, or another value or range of values within, outside, or overlapping this range. A third leg 76 extends downwardly at an angle away from the base 10 of the clips 2, 6, such as at an angle of 20 to 110 degrees from a horizontal plane (e.g., the x-y plane), or another value that is within, overlaps, or is outside of this range. A connector u-shaped leg 78 (e.g., fourth leg) extends from the connector third leg 76, and a connector fifth leg 80 extends from the connector u-shaped leg 78 to form the hook 36. The connector fifth leg 80 is bent in an orientation that is generally parallel to the connector third leg 76. In other embodiments of the invention the connector fifth leg 80 may be between generally parallel to the horizontal plane (e.g., the x-y plane) of the clips 2, 6 to generally parallel with the connector third leg 76 or converging with the third leg 76. The legs of the connector clips 34, 64 form a general connector clip cavity 90 within the connector clips 34, 64, which may include a connector first clip cavity 92 between the connector first leg 72 and the connector second leg 74, a second connector clip cavity 94 between the connector second leg 74 and the connector third leg 76, and a connector third cavity 96 (or hook cavity) within the hook 36, 66 formed by the connector third leg 76, the connector u-shaped leg 78 (e.g., connector fourth leg), and the connector fifth leg 80.

Figure 14A:
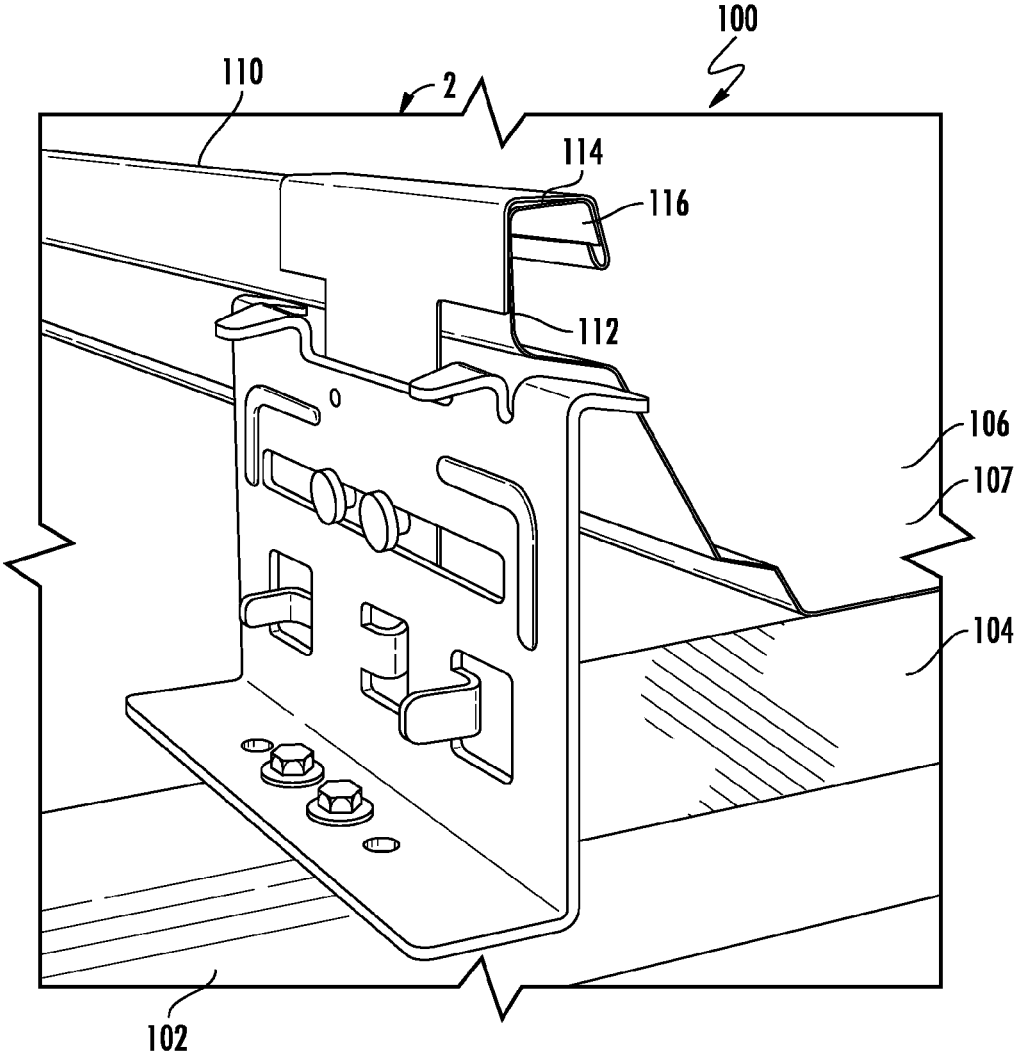
FIG. 14*a* illustrates a perspective view of a panel clip operatively coupled to a single panel, in accordance with embodiments of the present disclosure.

FIG. 14*a* illustrates a perspective view of one embodiment of the installation of panel clip 2 in a roof decking system 100. As illustrated in FIG. 14*a*, a building structure, which may include a support member 102 (e.g., a purlin, joist, or other like member) may have insulation 104 operatively coupled to the support member 102 (e.g., insulation 104 resting on the member 102, adhesive securing the two together, fastened together using fasteners, or the like). The insulation may include a thermal foam block and/or roll insulation. A first decking panel 106 is operatively coupled to the support member 102 and/or insulation 104, such that the insulation 104 is located between the support member 102 and the first decking panel 106. The first decking panel 106 may have any type of profile that can be utilized with the clips 2, 6 of the present invention. For example, in the illustrated embodiment the first decking panel 106 may have a male edge 110 with a male first leg 112 that extends in a generally vertical upward direction (e.g., the x-z plane), such as approximately 90 degrees from a horizontal plane (e.g., the x-y plane) of the first decking panel 106, or in other embodiments between 60 to 120 degrees, or another value or range of values within, outside, or overlapping this range). A male second leg 114 extends inwardly from the male first leg 112 back towards the first decking panel 106 in a generally horizontal direction, such as approximately 0 degrees from a horizontal plane (e.g., the x-y plane) of the first panel 106, or in other embodiments between −45 and +45 degrees, or another value or range of values within, outside, or overlapping this range. A male third leg 116 extends downwardly at an angle back towards the middle of the first decking panel 106, such as at an angle of 20 to 90 degrees from the horizontal plane (e.g., the x-y plane), or another value that is within, overlaps, or is outside of this range. As explained in further detail later, the male edge 110 of the first decking panel 106 is configured to fit within the cavity 90 of the connectors 30, 60, 160. Moreover, the first decking panel 106 may include additional bends in the panel in order to connect the male edge 110 of the first decking panel 106 with a trough 107 of the first decking panel 106.

The panel clip 2 is operatively coupled to the support member 102, such as through the use of fasteners that are inserted through the fastener apertures 20 in the foot 12 of the base 10 of the panel clip 2. In some embodiments fasteners, such as threaded self-drilling screws extend through the aligned apertures 20 in the foot 12 of the panel clip 2 and into the support member 102. The fasteners secure the panel clip 2 to the support structure 102 (e.g., purlin, joist, or the like). In other embodiments of the invention the panel clip 2 may be operatively coupled to the support member 102 of the roof decking system 100 in other ways, such as but not limited to different types of couplings, such as fasteners (e.g., rivets, or the like), welds, or the like. As illustrated by FIGS. 14*a*-17, the support member 102 (e.g., purlin, joist, or the like) supports the insulation 104 between the support member 102 and the roof panels 106, 108. At least one of the base tabs 52 may be inserted into the insulation 104 (e.g., thermo foam block), or otherwise surround the insulation 104, in order to help secure the insulation 104 and prevent it from moving within the decking system 100. The panel connector clip 34 is placed over the first decking panel 106 male edge 110 such that male edge 110 is located with the cavity 90 of the connector 30. The assembly device 44 is located in the base assembly aperture 46 of the base 10 of the panel clip 2 and the connector assembly aperture 39 of the connector 30 of the panel clip 2 to prevent movement of the panel connector 30 with respect to the base 10 during installation of the decking system 100.

Figure 14B:
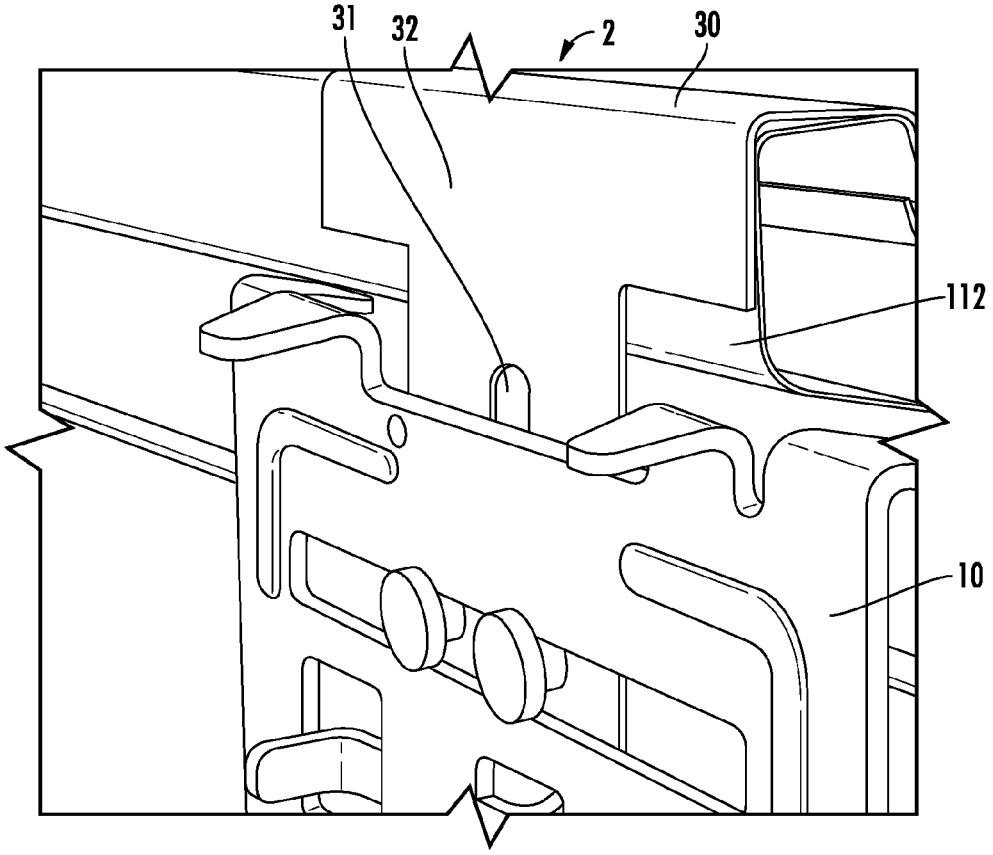
FIG. 14*b* illustrates an enlarged perspective view of a panel clip operatively coupled to a single panel, in accordance with embodiments of the present disclosure.

FIG. 14*b* illustrates a perspective view in which the connector rib 31 only extends to a position on the plate 32 of the connector 30 such that it would not interfere with the male first leg 112 of the male edge 110 of the first decking panel 106. Moreover, in some embodiments the connector rib 31 may help to locate the male first leg 112 and/or the male edge 110 of the first decking panel 106 within the general connector clip cavity 90.

Figure 15:
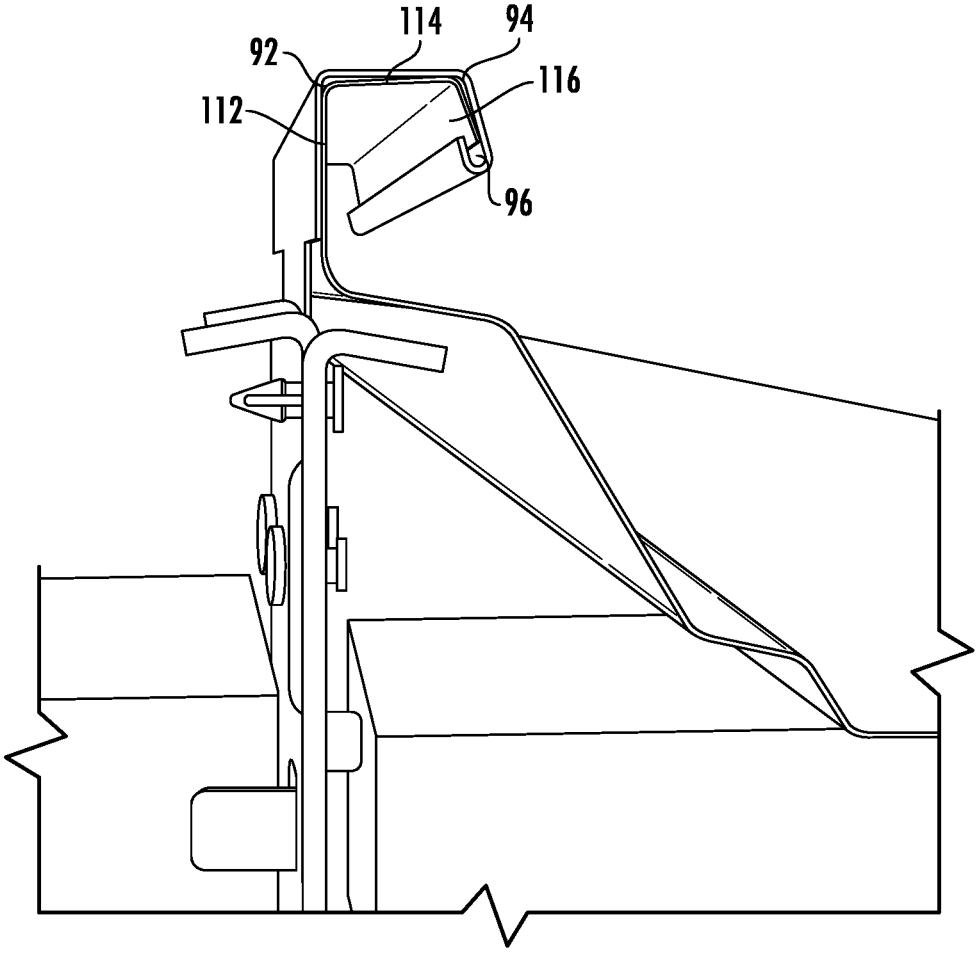
FIG. 15 illustrates a side view of the panel clip of FIG. 14*a* operatively coupled to the single panel, in accordance with embodiments of the present disclosure.

FIG. 15 illustrates an end view of the panel clip 2 operatively coupled to the male edge 110 of the first decking panel 106. As illustrated by FIG. 15, the male third leg 116 is located within the connector third cavity 96 (e.g., the cavity created by the hook 36). The corner of the male second leg 114 and male third leg 116 is located within the connector second cavity 94. The corner of the male first leg 112 and the male second leg 114 is located within the connector first cavity 92.

Figure 16:
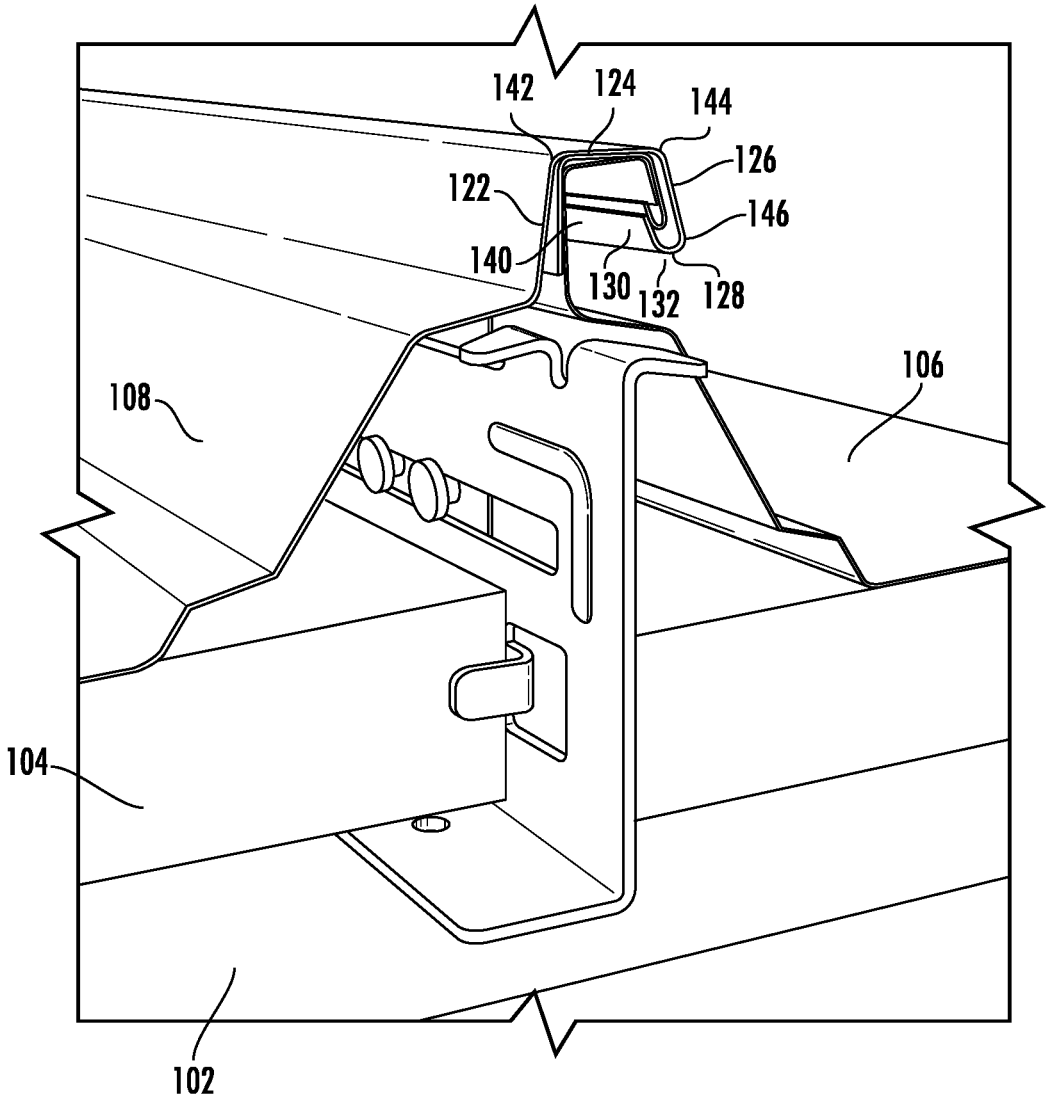
FIG. 16 illustrates a perspective view of the panel clip of FIG. 14*a* operatively coupled to two panels, in accordance with embodiments of the present disclosure.
Figure 17:
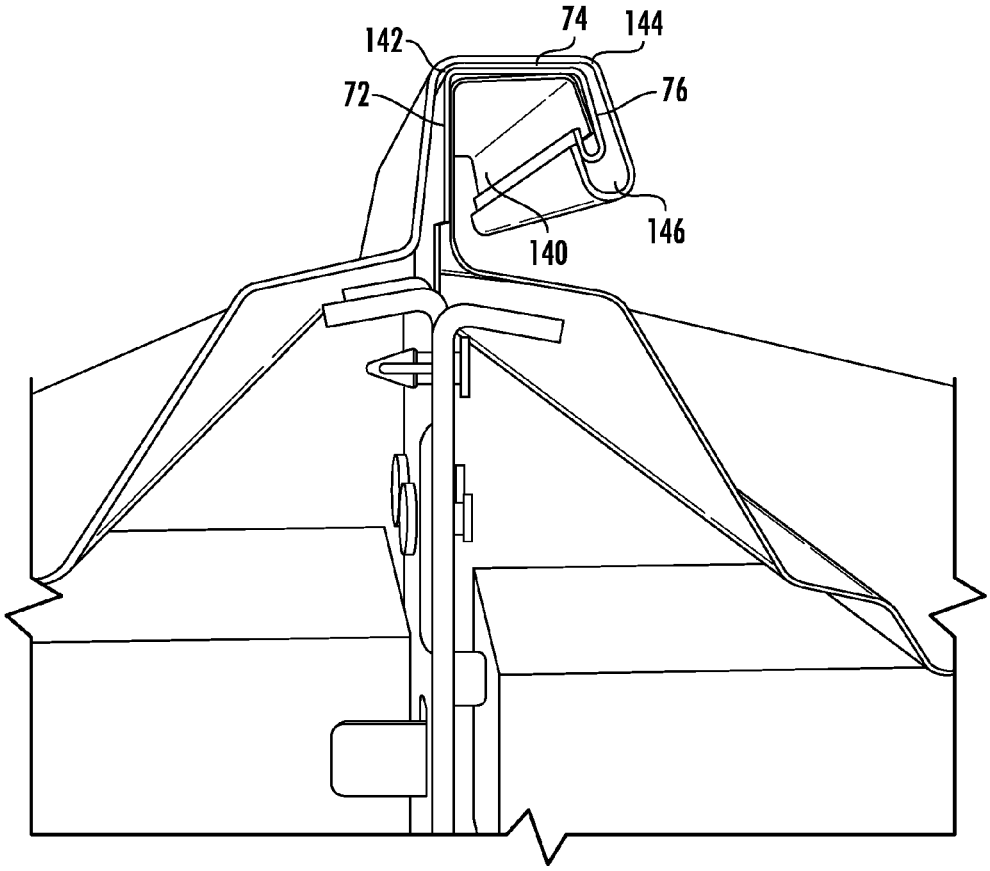
FIG. 17 illustrates an end view of the panel clip of FIG. 16 operatively coupled to the two panels, in accordance with embodiments of the present disclosure.

As illustrated in FIGS. 16 and 17, a second decking panel 108 is operatively coupled to the support member 102 and/or additional insulation 104, such that the insulation 104 is located between the support member 102 and the second decking panel 108. The second decking panel 108 may have any type of profile that can be utilized with the clips 2, 6 of the present invention. For example, in the illustrated embodiment the second decking panel 108 may have a female edge 120 with a female first leg 122 that extends in a generally vertical upward direction (e.g., the x-z plane), such as approximately 90 degrees from a horizontal plane (e.g., the x-y plane) of the second decking panel 108, or in other embodiments between 60 to 120 degrees, or another value or range of values within, outside, or overlapping this range. A female second leg 124 extends outwardly from the female first leg 122 away from second panel 108 in a generally horizontal direction, such as approximately 0 degrees from a horizontal plane (e.g., the x-y plane) of the second decking panel 108, or in other embodiments between −45 and +45 degrees, or another value or range of values within, outside, or overlapping this range. A female third leg 126 extends downwardly at an angle away from the second decking panel 108 (and towards the adjacent first decking panel 106), such as at an angle of 20 to 110 degrees, or another value that is within, overlaps, or is outside of this range. A female u-shaped leg 128 (e.g., fourth leg) extends from the female third leg 126, and a female fifth leg 130 extends from the female u-shaped leg 128 to form a female hook 132. The female fifth leg 130 is bent in an orientation that is generally parallel to the female third leg 126. In other embodiments of the invention the female fifth leg 130 may be between generally parallel to the horizontal plane (e.g., the x-y plane) of the panels 106, 108 and clips 2, 6 to generally parallel with the female third leg 126 or converging with the female third leg 126. The legs of the female edge 120 forms a general female cavity 140 within the female edge 120, which may include a female first cavity 142 between the female first leg 122 and the female second leg 124, a female second cavity 144 between the female second leg 124 and the female third leg 126, and a female third cavity 146 (e.g., female hook cavity) within the female hook 132 formed by the female third leg 126, the female u-shaped leg 128 (e.g., the female fourth leg), and the female fifth leg 130.

FIG. 17 illustrates an end view of the panel clip 2 operatively coupled to the male edge 110 of the first panel 106 and the female edge 120 of the second panel 108. As illustrated by FIG. 17, the connector clip 30 is located within the female cavity 140. Specifically, the connector hook 36 is located within the female third cavity 146 (e.g., female hook cavity). The corner of the connector second leg 74 and connector third leg 76 is located within the female second cavity 144. The corner of the connector first leg 72 and the connector second leg 74 is located within the female first cavity 142.

Figure 18:
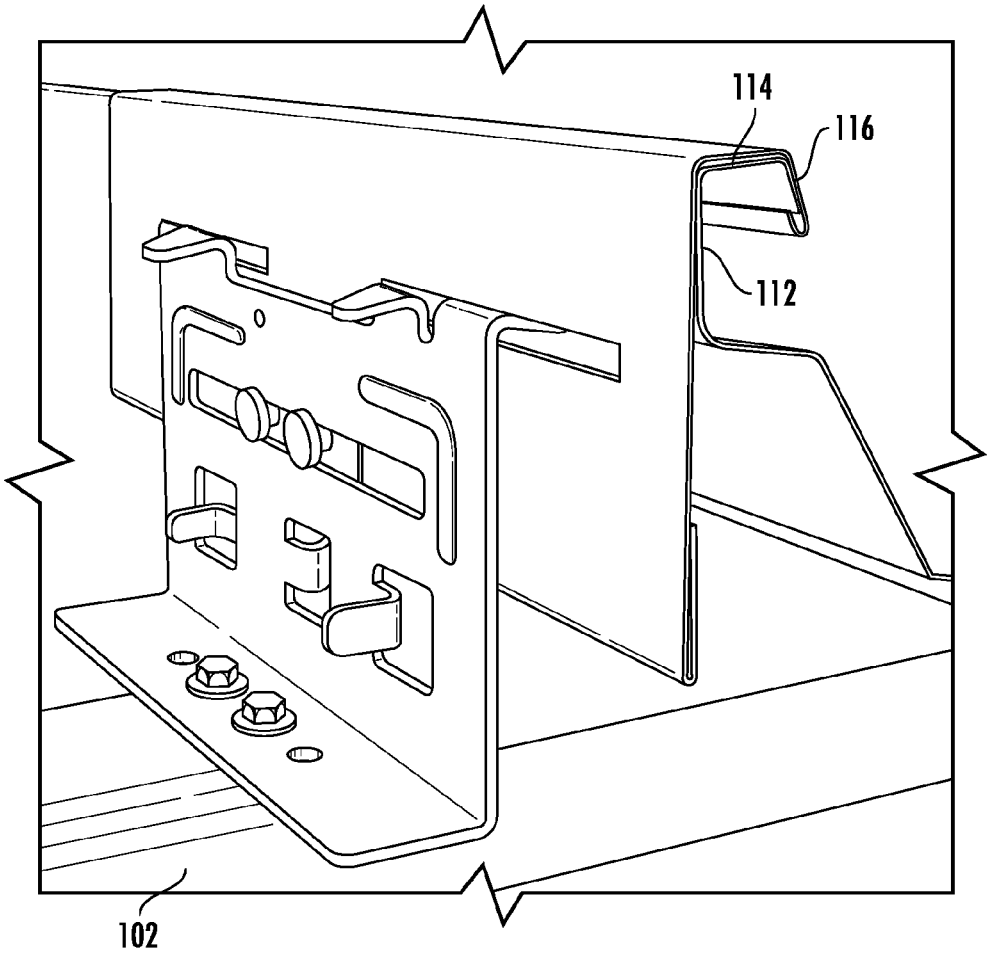
FIG. 18 illustrates a perspective view of a perimeter clip operatively coupled to a single panel, in accordance with embodiments of the present disclosure.

The perimeter clips 6 described herein may be utilized within the decking system 100 in a similar way as previously described with respect to the panel clips 2. For example, FIG. 18 illustrates a perspective view of embodiments of the installation of the perimeter clip 6 in a roof decking system 100. As illustrated in FIG. 18, a building structure, which may include one or more support members 102 (e.g., purlins, joists, or other like members) may have insulation 104 operatively coupled to the support member 102, as previously described with respect to FIG. 14*a*. As also previously described with respect to FIG. 14*a*, a first decking panel 106 is operatively coupled to the support member 102 and/or insulation 104, such that the insulation 104 is located between the support member 102 and the first decking panel 106. The first decking panel 106 may have any type of profile that can be utilized with the clips 2, 6 of the present invention. For example, in the illustrated embodiment the first decking panel 106 may have an male edge 110 with a male first leg 112 that extends in a generally vertical upward direction (e.g., the x-z plane), such as approximately 90 degrees from a horizontal plane (e.g., the x-y plane) of the first decking panel 106, or in other embodiments between 60 to 120 degrees, or another value or range of values within, outside, or overlapping this range. A male second leg 114 extends inwardly from the male first leg 112 back towards the first decking panel 106 in a generally horizontal direction, such as approximately 0 degrees from a horizontal plane (x-y plane) of the first decking panel 106, or in other embodiments between −45 and 45 degrees, or another value or range of values within, outside, or overlapping this range. A male third leg 116 extends downwardly at an angle back towards the middle of the first decking panel 106, such as at an angle of 20 to 110 degrees, or another value that is within, overlaps, or is outside of this range. As explained in further detail later the male edge 110 of the first panel 106 is configured to fit within the cavity 90 of the perimeter connector 60. Moreover, the first decking panel 106 may include additional bends in the panel in order to connect the male edge 110 of the first decking panel 106 with a trough 107 of the first decking panel 106.

The perimeter clip 6 is operatively coupled to the support member 102, such as through the use of fasteners that are inserted through the fastener apertures 20 in the foot 12 of the base 10 of the perimeter clip 6. In some embodiments fasteners, such as threaded self-drilling screws extend through the aligned apertures 20 in the foot 12 of the perimeter clip 6 into the support member 102. The fasteners secure the perimeter clip 6 to the support member 102 (e.g., purlin, joist, or other like member). In other embodiments of the invention the perimeter clip 6 may be operatively coupled to the support member 102 of the roofing decking system 100 in other ways, such as but not limited to other couplings, such as fasteners (e.g., rivets, or the like), welds, or the like. As illustrated by FIG. 18, the support member 102 (e.g., purlin, joist, or the like) supports the insulation 104 between the purlin 102 and the roof panels 106, 108. At least one of the base insulation tabs 52 (if included on the base 10) may be inserted into the insulation 104, or surround the insulation 104, in order to help secure the insulation 104 and prevent it from moving within the decking system 100. The perimeter connector clip 64 is placed over the first decking panel 106 male edge 110 such that male edge 110 is located with the cavity 90 of the perimeter connector 60. The assembly device 44 is located in the base assembly aperture 46 of the base 10 of the perimeter clip 6, and the connector assembly aperture 69 of the connector 60 of the perimeter clip 6 to prevent movement of the connector 60 with respect to the base 10 during installation of the decking system 100.

Figure 19:
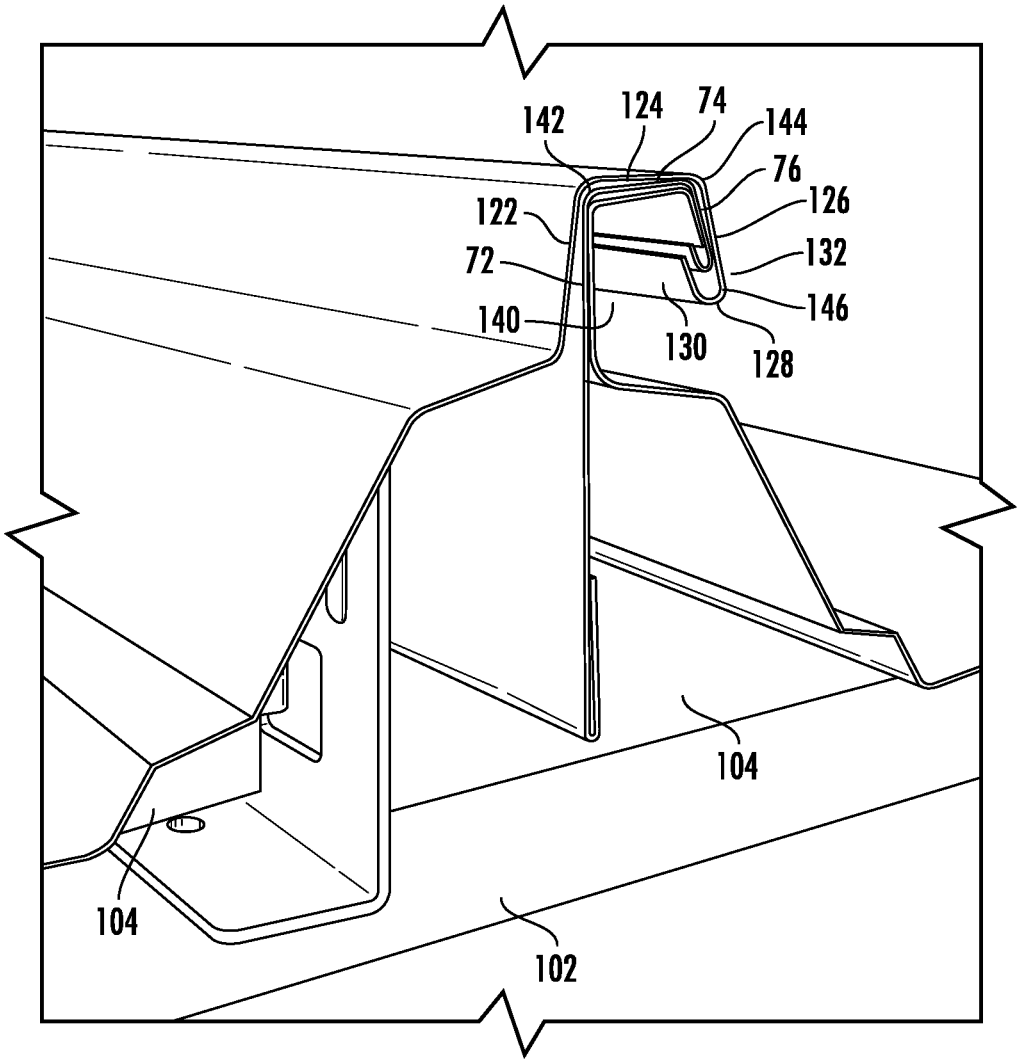
FIG. 19 illustrates a perspective view of the perimeter clip of FIG. 18 operatively coupled to two panels, in accordance with embodiments of the present disclosure.

FIG. 19 illustrates that a second decking panel 108 is operatively coupled to the support member 102 and/or additional insulation 104, such that the insulation 104 is located between the support member 102 and the second decking panel 108. The second decking panel 108 may have any type of profile that can be utilized with the perimeter clips 6 of the present invention. For example, in the illustrated embodiment the second decking panel 108 may have a female edge 120 with a female first leg 122 that extends in a generally vertical upward direction (e.g., the x-z plane), such as approximately 90 degrees from a horizontal plane (e.g., the x-y plane) of the second decking panel 108, or in other embodiments between 60 to 120 degrees, or another value or range of values within, outside, or overlapping this range). A female second leg 124 extends outwardly from the female first leg 122 away from second decking panel 108 in a generally horizontal direction, such as approximately 0 degrees from a horizontal plane (e.g., the x-y plane) of the second decking panel 108, or in other embodiments between −45 and 45 degrees, or another value or range of values within, outside, or overlapping this range. A female third leg 126 extends downwardly at an angle away from the second decking panel 108 (and towards the adjacent first panel 106), such as at an angle of 20 to 110 degrees from the horizontal plane (e.g., the x-y plane), or another value that is within, overlaps, or is outside of this range. A female u-shaped leg 128 (e.g., fourth leg) extends from the female third leg 126, and a female fifth leg 130 extends from the female u-shaped leg 128, to form a female hook 132. The female fifth leg 130 is bent in an orientation that is generally parallel to the female third leg 126. In other embodiments of the invention the female fifth leg 130 may be between generally parallel to the horizontal plane (e.g., the x-y plane) of the decking panels 106, 108 or clips 2, 6 to generally parallel with the female third leg 126 or converging with the female third leg 126. The legs of the female edge 120 form a general female cavity 140 within the female edge 120, which may include a female first cavity 142 between the female first leg 122 and the female second leg 124, a female second cavity 144 between the female second leg 124 and the female third leg 126, and a female third cavity 146 (e.g., female hook cavity) within the female hook 132 formed by the female third leg 126, the female u-shaped leg 128, and the female fifth leg 130.

As previously described with respect to FIGS. 16 and 17, the perimeter clips 6 illustrated in FIGS. 18 and 19 are operatively coupled to the male edge 110 of the first decking panel 106 and the female edge 120 of the second decking panel 108. As illustrated by FIGS. 18 and 19, the connector clip 60 is located within the general female cavity 140. Specifically, the connector hook 66 is located within the female third cavity 146 (e.g., female hook cavity). The corner of the connector second leg 74 and connector third leg 76 is located within the female second cavity 144. The corner of the connector first leg 72 and the connector second leg 74 is located within the female first cavity 142.

Regardless of the type of clip 2, 6 utilized, the seam between the first decking panel 106 and the second decking panel 108, which may or may not include the connectors 30, 60, 160 of the clips 2, 6, may be operatively coupled together manually, or automatically using a machine, for example by bending, crimping, and/or folding the female edge 120, male edge 110, and connector clip 64 to create the locking means in the seam.

Figure 20:
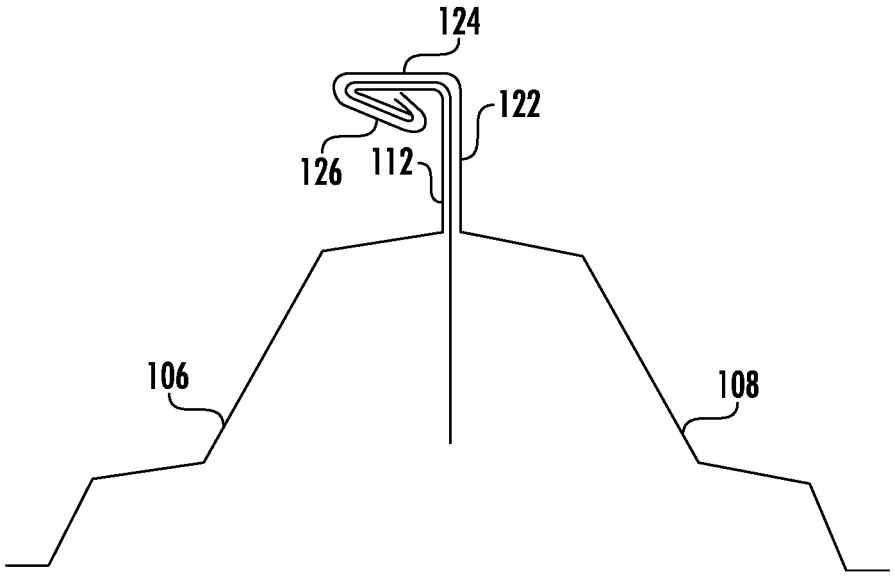
FIG. 20 illustrates an end cross-sectional view of the panel clip or perimeter clip with a locking means at the only the clip, in accordance with embodiments of the present disclosure.
Figure 21:
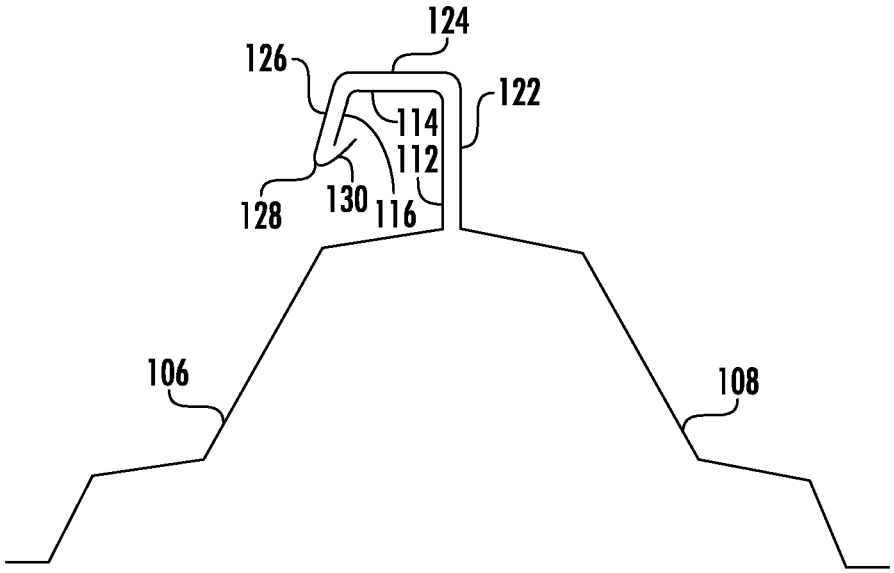
FIG. 21 illustrates an end cross-sectional view of the seam when only a locking means at the clip is used, in accordance with embodiments of the present disclosure.

FIG. 20 illustrates a side cross-sectional view of the panel clip 2 or perimeter clip 6 described in FIGS. 1-19, with a locking means that operatively couples the clips 2, 6 to the edges of adjacent decking panels 106, 108. As illustrated in FIG. 20 the locking means of the seam may include operatively coupling the seam together at only at a portion of the seam at which the edges of the decking panels 106, 108 meet with the clips 2, 6. As illustrated by FIG. 21, when no clip is located between the edges of the decking panels, in some embodiments, the seam is not locked together. In some embodiments of the invention the locking means of the seam illustrated in FIG. 20 is formed using a manual seaming tool. In other embodiments of the invention the seaming tool may be an automatic tool.

Figure 22:
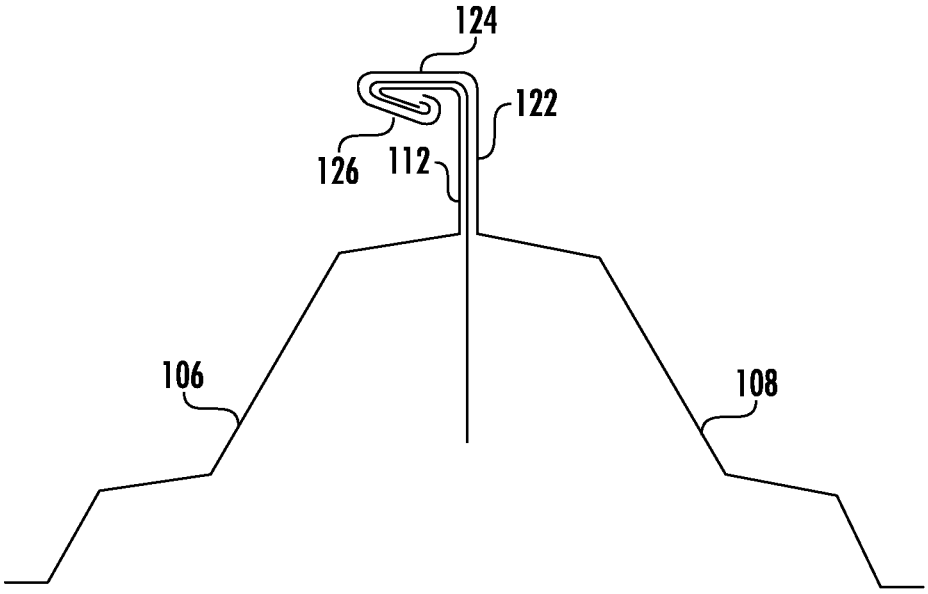
FIG. 22 illustrates an end cross-sectional view of the panel clip or perimeter clip with a locking means along the seam, in accordance with embodiments of the present disclosure.
Figure 23:
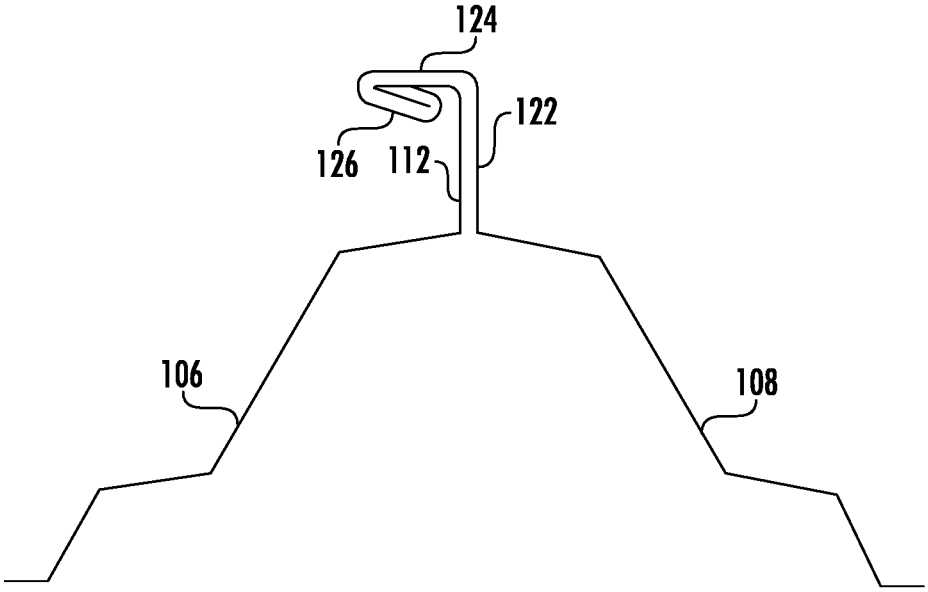
FIG. 23 illustrates an end cross-sectional view of the seam when a locking means along the seam is used, in accordance with embodiments of the present disclosure.

FIG. 22 illustrates a side cross-sectional view of the panel clip 2 or perimeter clip 6 described in FIGS. 1-19, with a locking panel that operatively couples the clips 2, 6 to the edges of adjacent decking panels 106, 108. As illustrated in FIG. 22 the locking means of the seam may include operatively coupling the seam together at a portion of the seam at which the edges of the decking panels 106, 108 meet with the clips 2, 6, as well as along the seam at locations where the clip is not located, as illustrated by FIG. 23. In some embodiments of the invention the locking means of the seam illustrated in FIGS. 22 and 23 is formed using an automatic bi-directional seaming device (i.e., can seam in either direction).

FIGS. 20, 22, and 23 illustrate a locking means in which the male third leg 116, the female third leg 126, the female u-shaped forth leg 128, and the female fifth leg 130, and the connector third leg 76, connector u-shaped forth leg 78, and connector fifth leg 80 (where applicable) are crimped together and/or bent back upon the male second leg 114 and the female second leg 124, and the connector second leg 74 (where applicable) to form the locking means. These legs may be bent back to an angle that is between 10 and 80 from the plane of the male second leg 114, female second leg 124, and the connector second leg 74 (e.g., from the x-y plane).

Figure 24:
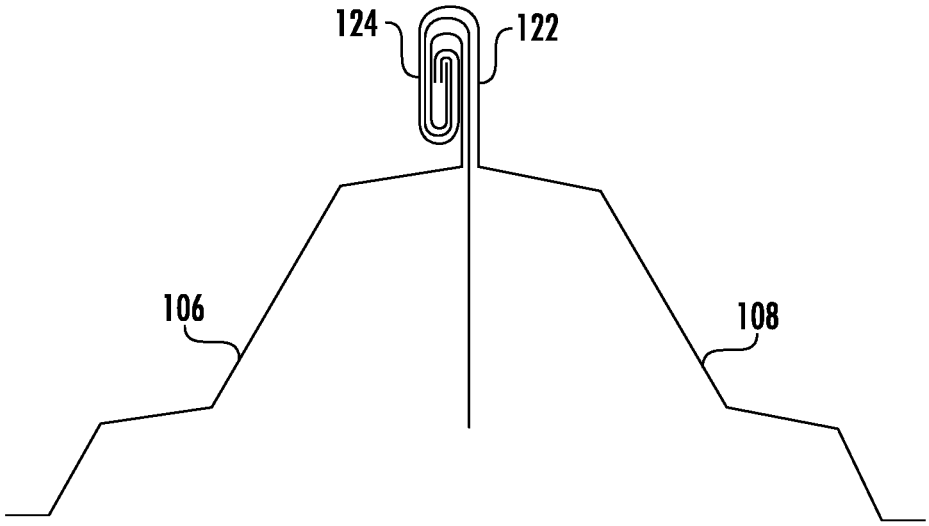
FIG. 24 illustrates an end cross-sectional view of the panel clip or perimeter clip with a double locking means along the seam, in accordance with embodiments of the present disclosure.
Figure 25:
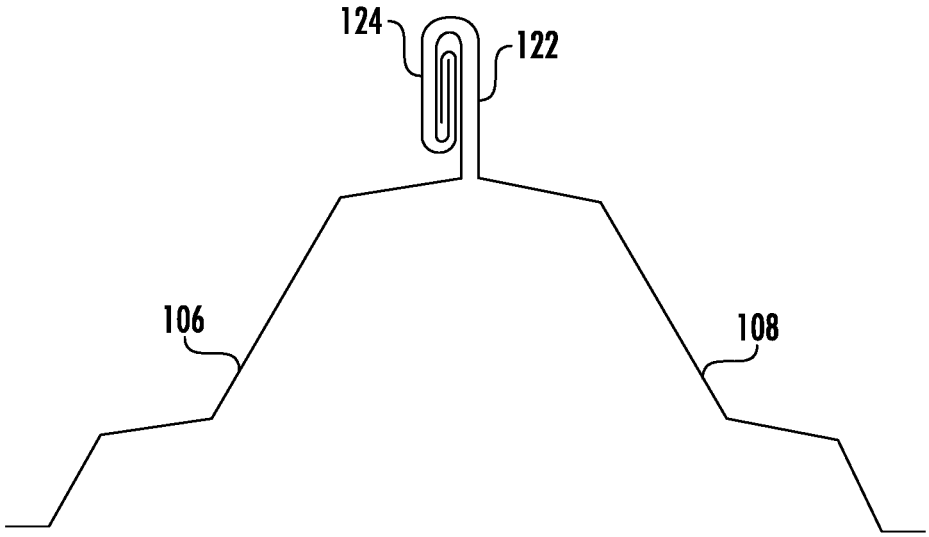
FIG. 25 illustrates an end cross-sectional view of the seam when a double locking means along the seam is used, in accordance with embodiments of the present disclosure.

FIG. 24 illustrates a side cross-sectional view of the panel clip 2 or perimeter clip 6 described in FIGS. 1-19, with a locking means that operatively couples the clips 2, 6 to the edges of adjacent decking panels 106, 108. As illustrated in FIG. 24 the locking means of the seam may include operatively coupling the seam together at a portion of the seam at which the edges of the decking panels 106, 108 meet with the clips 2, 6, as well as along the seam at locations where the clip is not located, as illustrated by FIG. 25. In some embodiments of the invention the locking means of the seam illustrated in FIGS. 24 and 25 is formed using an automatic seaming device.

FIGS. 24 and 25 illustrate a locking system in which the male third leg 116, the female third leg 126, the female u-shaped forth leg 128, and the female fifth leg 130, and the connector third leg 76 and connector u-shaped forth leg 78, and connector fifth leg 80 (where applicable) are crimped together and/or bent back upon the male second leg 114 and the female second leg 124, and the connector second leg 74 (where applicable). These legs may be bent back to an angle that is between 0 and 60 degrees from the plane of the male second leg 114, female second leg 124, and the connector second leg 74 (e.g., from the x-y plane), and in some these legs are bent generally parallel to each other (e.g., bent back on each other). Moreover, these legs may be further crimped and/or bent back upon the male first leg 112 and the second female leg 122, as well as back upon the connector first leg 72 (e.g., in an orientation that is generally vertical in the z-axis) to create the locking means of the seam illustrated in FIGS. 24 and 25.

It should be understood that the seams discussed in FIGS. 20-25, or other seams not specifically discussed herein, may be utilized throughout the decking system 100 in any combination. However, it should be understood that in some aspects of the invention, only a single type of seam may be utilized at the locations of the clips 2, 6, while other types of seams are utilized in the locations of the seams without the clips. Moreover, as discussed throughout this application different seams may be utilized between different decking panels at different locations.

Figure 26:
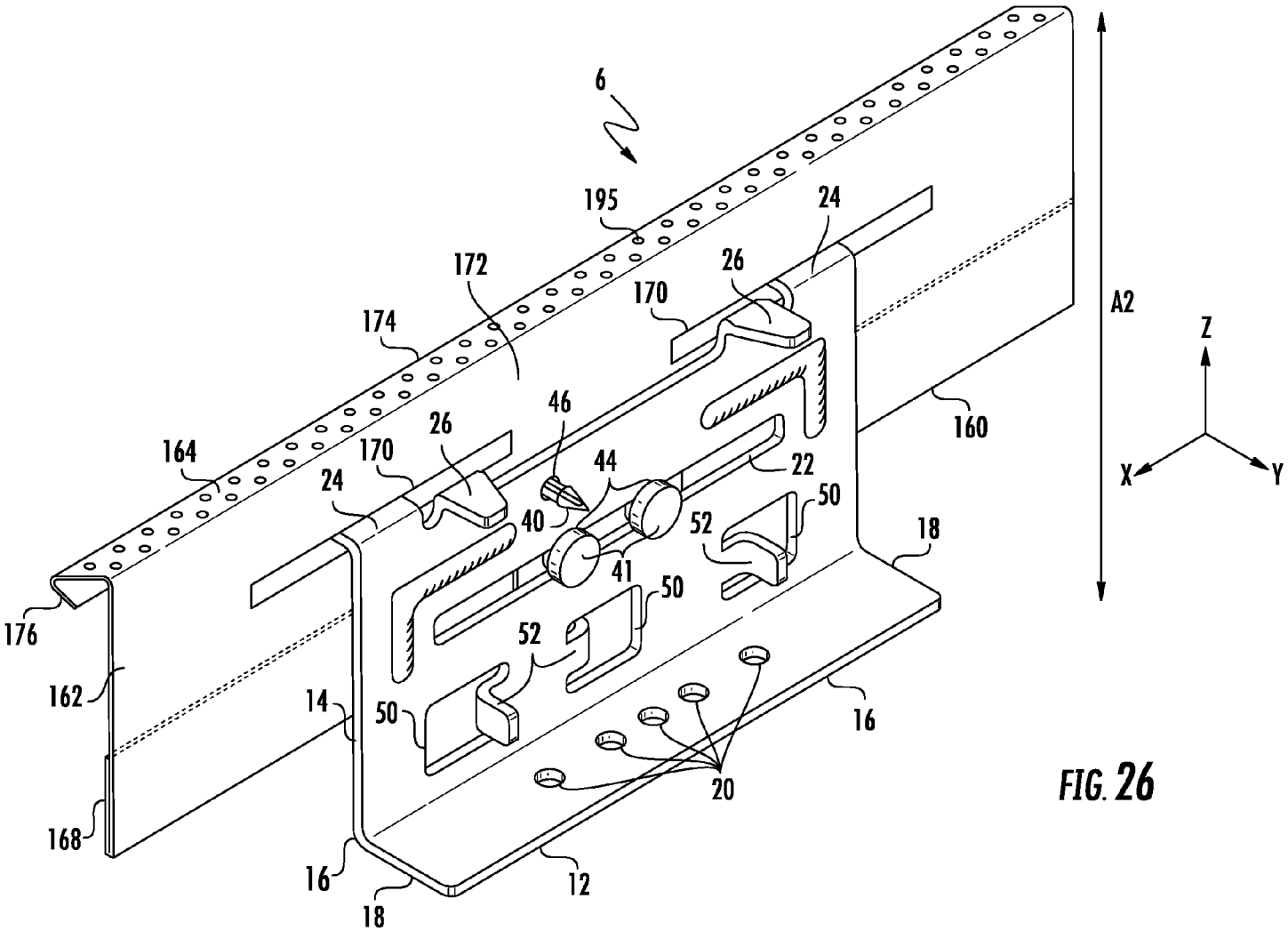
FIG. 26 illustrates a perspective view a perimeter clip used between the edges of adjacent panels, in accordance with embodiments of the present disclosure.
Figure 27:
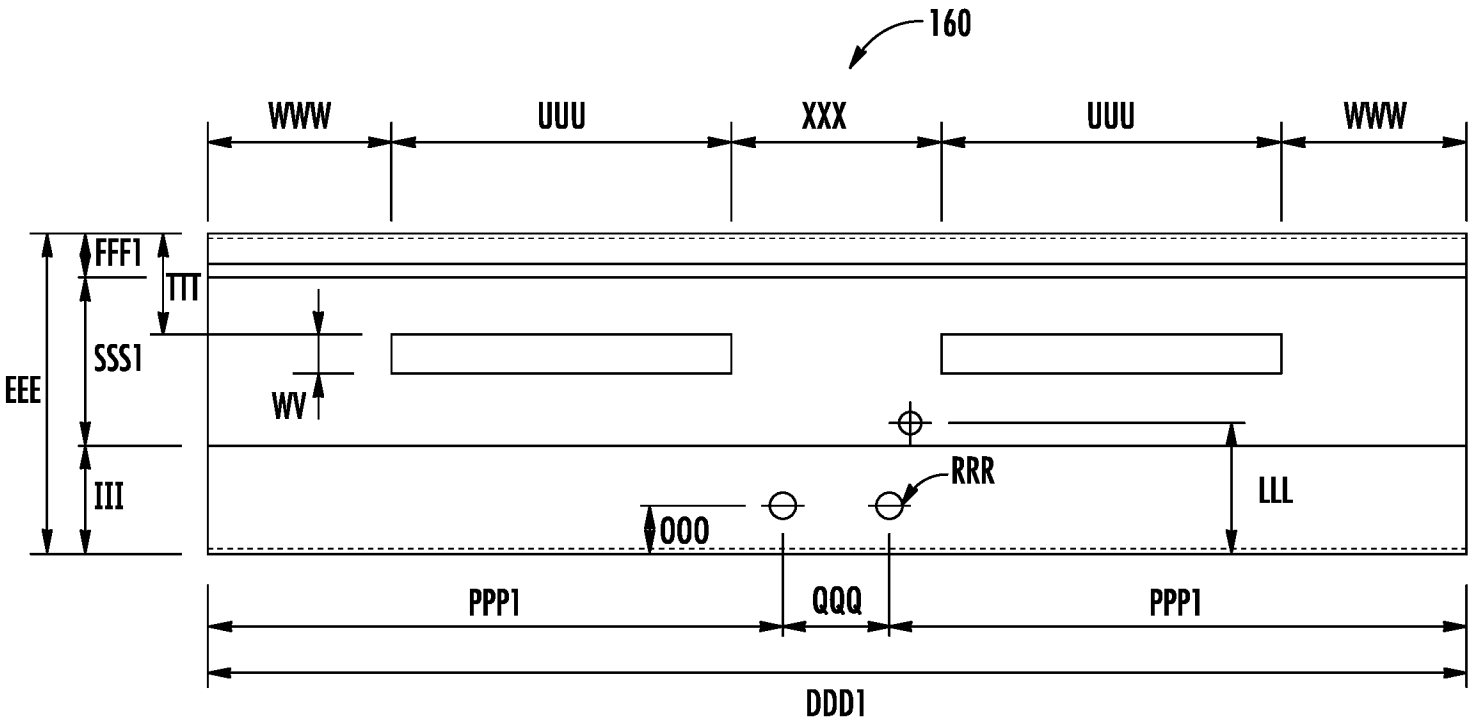
FIG. 27 illustrates a front view of the connector of the perimeter clip of FIG. 26, in accordance with embodiments of the present disclosure.
Figure 28:
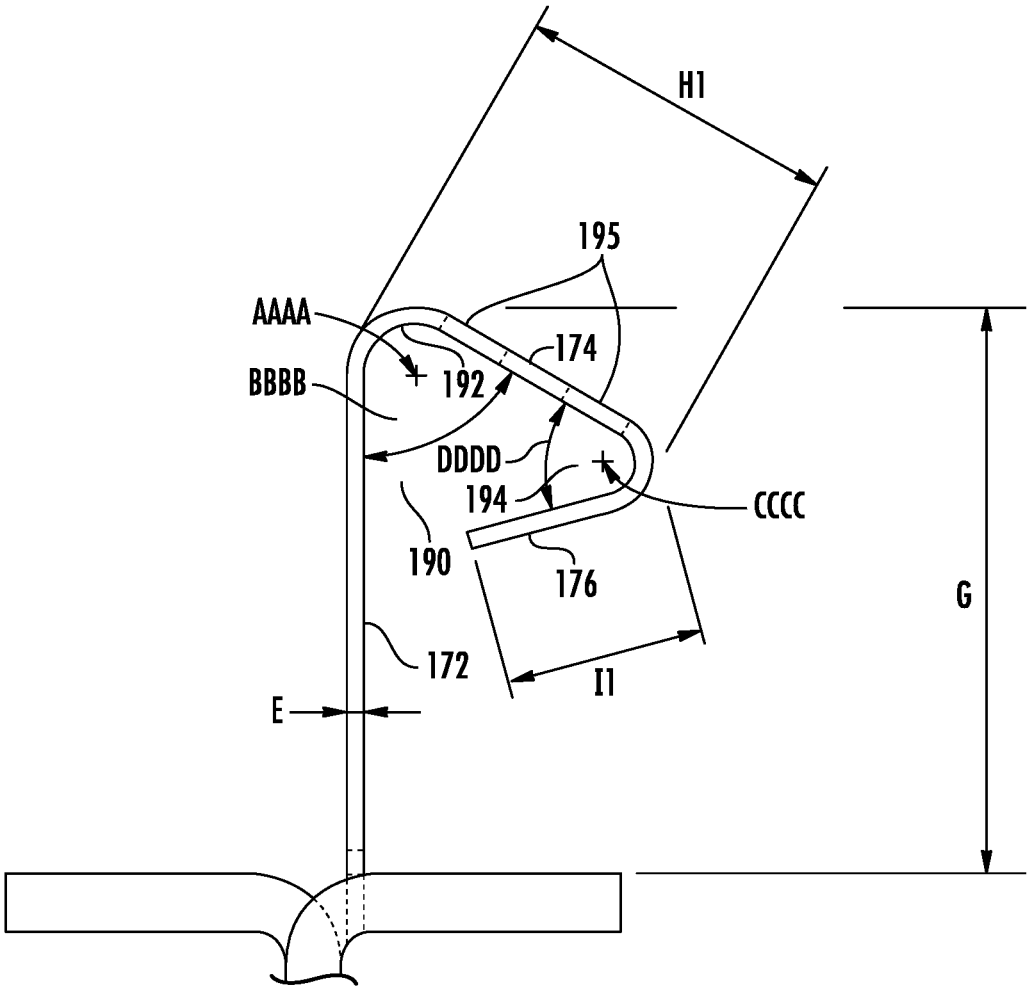
FIG. 28 illustrates an enlarged view of the hook of the connector of the perimeter clip of FIG. 26, in accordance with embodiments of the present disclosure.

FIGS. 26 through 28 illustrate another embodiment of the perimeter clip 6 described herein. As illustrated in FIGS. 26-28 the perimeter clip 6 has the same base 10 as previously described for the other clips 2, 6 described herein (e.g., the standard, short, zero offset, and tall clips). Moreover, as illustrated in FIGS. 26-28 the perimeter clip 6 also has a connector 160 that is similar to the connectors 60 previously described. However, the perimeter clip 6 illustrated in FIGS. 26 through 28 illustrates that the connector 160 has a different connector clip 164 as well as different dimensions. As such, the perimeter connector 160 has a perimeter plate 162 and a perimeter connector clip 164 extending from the perimeter plate 162, and in some embodiments may have a hook 166 within the connector clip 164.

In some embodiments, the perimeter plate 162 of the perimeter connector 160 has one or more perimeter connector slots 170 (e.g., two slots in the illustrated embodiment) through which one or more base tabs (e.g., the base outer top tabs 24, the base inner top tabs 26, or the like) are located. As such, the one or more perimeter connector slots 170 may prevent further movement of the perimeter connector 160 with respect to the base 10 (e.g., further sliding of the fasteners 40 within the slot 22) when an edge of the one or more perimeter connector slots 170 contacts the base tabs (e.g., the base outer top tab 24). In other embodiments the fasteners 40 may prevent further movement of the perimeter connector 160 with respect to the base 10 when one of the fasteners contact and edge of base slot 22. As previously described with respect to the panel clip 2, and the perimeter clips 6 in FIGS. 11-13, in some aspects of the invention it may be beneficial for the perimeter connector 160 and base 10 (e.g., tabs) to prevent additional sliding with respect to each other instead of the fasteners 40 contacting an edge of the base slot 22. If the fasteners 40 are allowed to contact an edge of the base slot 22 to prevent further movement between the perimeter connector 160 and the base 10, the fastener 40 may become jammed in the base slot 22, and thus prevent additional sliding.

The connector 160, in one embodiment, as illustrated by FIG. 28, may have a connector first leg 172 that extends from, or is otherwise integral with, the plate 162, which extends generally vertically with respect to the clips 2, 6 (e.g., in the x-z plane), such as approximately 90 degrees from a horizontal plane (e.g., the x-y plane) of the clips 2, 6, or in other embodiments between 60 and 120 degrees, or another value or range of values within, outside, or overlapping this range. A connector second leg 174 extends generally downwardly towards the base 10 and away from first leg 172. The second leg 172 may be angled downwardly at 30 degrees from a horizontal plane (e.g., the x-y plane) of the clip 2, 6, or in other embodiments between 10 and 60 degrees, or another value or range of values within, outside, or overlapping this range. A third leg 176 extends inwardly towards the first leg 172 at an angle from the second leg 172 of approximately 45 degrees, such as at an angle that ranges from 20 to 70 degrees, or another value that is within, overlaps, or is outside of this range. In some embodiments (not illustrated), a connector u-shaped leg extends from the connector third leg 176, and a connector fifth leg extends from the connector u-shaped leg to form a hook. The connector fifth leg may be bent in an orientation that is generally parallel to the connector third leg 176. The legs of the connector clip 164 forms a general connector clip cavity 190 within the connector clip 164, which may include a connector first clip cavity 192 between the connector first leg 172 and the connector second leg 174 and a second connector clip cavity 194 between the connector second leg 174 and the connector third leg 176. In some embodiments where the connector clip 164 also has a hook, the connector clip 164 may include a connector third cavity (or hook cavity) within the hook formed by the connector third leg, the connector u-shaped leg (e.g., connector fourth leg), and the connector fifth leg (not illustrated). It should be understood that the perimeter clip 6 described in FIGS. 26-28 may comprise the dimensions described in Table 1 and illustrated in FIGS. 27-28, and the other figures herein.

It should be understood that the perimeter clip 6 described in FIGS. 26-28 may be operatively coupled to decking panels 106, 108 in the same or similar way as previously discussed herein with respect to the panel clips 2 and perimeter clips 6 discussed in FIGS. **14*a*-19. In some aspects of the invention, as illustrated in FIGS. 26 and 28, one or more sealant apertures 195 are located in the connector second leg 174 (or another leg of the connector with respect to the various embodiments of the invention described herein). As such, when the perimeter clip 6 (or another clip discussed herein with sealant apertures 195 in a leg) is operatively coupled to decking panels 106,108 sealant may be placed over the sealant apertures 195 in order to allow the sealant to aid in operatively coupling the male edge 210, the connector 160, and the female edge 220 of the panel seams. The sealant apertures 195 can be used in lieu a placing a bead of sealant 193 in a cavity between the male edge and the connector, and/or the female edge and the connector (e.g., as illustrated in some example in FIGS. 1*a*, 8, 11, and 12**).

Figure 29A:
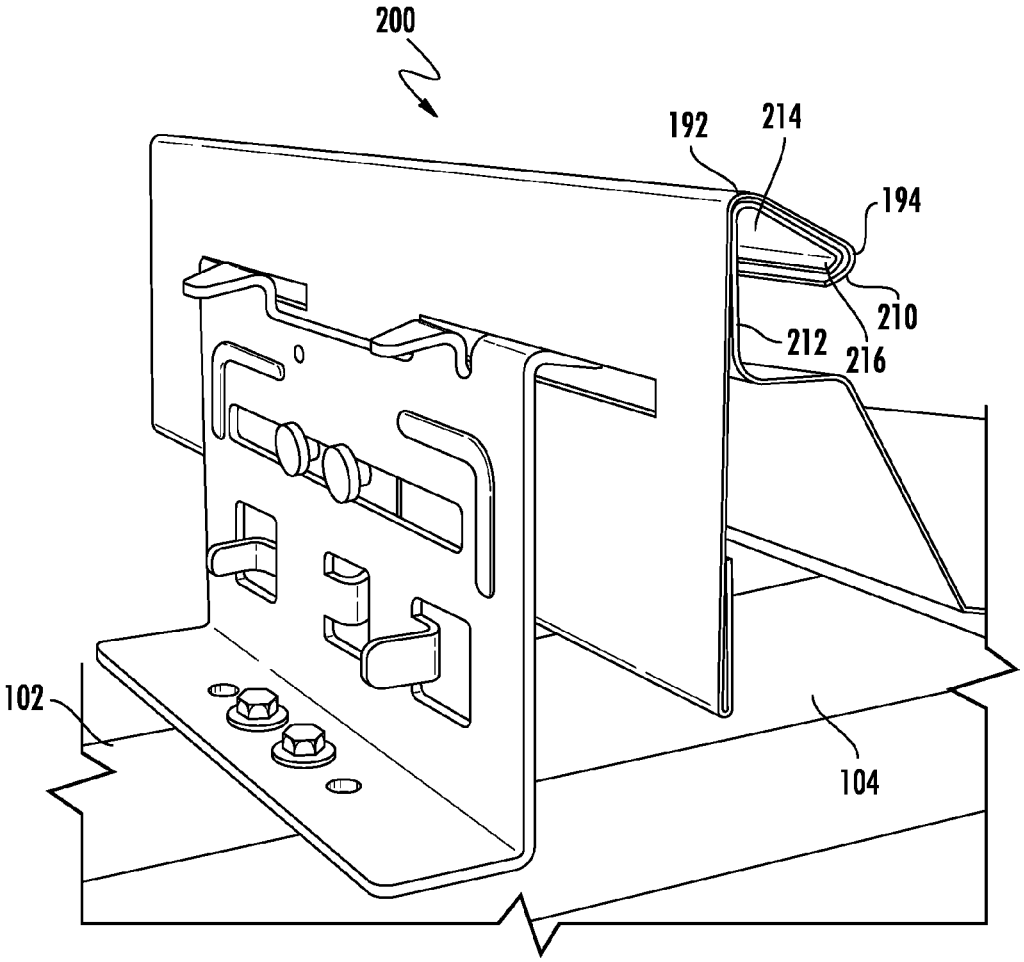
FIG. 29*a* illustrates a perspective view of a perimeter clip operatively coupled to a single panel, in accordance with embodiments of the present disclosure.

FIG. **29*a* illustrates a perspective view of embodiments of the installation of the perimeter clip 6 from FIGS. 26-28 in a roof decking system 200. As illustrated in FIG. 29*a*, a building structure, which may include one or more support members 102 (e.g., purlins, joists, or other like members) may have insulation 104 operatively coupled to the support member 102, as previously described with respect to FIG. 14*a*. As also previously described with respect to FIG. 14*a*, a first decking panel 106 is operatively coupled to the support member 102 and/or insulation 104, such that the insulation 104 is located between the support member 102 and the first decking panel 106. In the illustrated embodiment the first decking panel 106 may have a male edge 210 with a male first leg 212 that extends in a generally vertical upward direction (e.g., the x-z plane), such as approximately 90 degrees from a horizontal plane (e.g., the x-y plane) of the first decking panel 106, or in other embodiments between 60 to 120 degrees, or another value or range of values within, outside, or overlapping this range. A male second leg 214 extends inwardly and downwardly from the male first leg 212 back towards the first decking panel 106 in at an angle back towards the middle of the first decking panel 106, such as at an angle of 30 degrees from a horizontal plane (e.g., the x-y plane) of the first decking panel 106, or in other embodiments between 10 and 60 degrees, or another value or range of values within, outside, or overlapping this range. A male third leg 216 extends inwardly towards the male first leg 212 at an angle from the male second leg 214 of approximately 45 degrees, such as at an angle that ranges from 20 to 70 degrees, or another value that is within, overlaps, or is outside of this range. In some embodiments (not illustrated), a u-shaped male leg extends from the male third leg 216, and a male fifth leg extends from the male u-shaped leg to form a hook. The male fifth leg may be bent in an orientation that is generally parallel to the male third leg 216. The first decking panel 106 may include additional bends in the panel in order to connect the male edge 210 of the first decking panel 106 with a trough 107 of the first decking panel 106**.

The perimeter clip 6 is operatively coupled to the support member 102, such as through the use of fasteners that are inserted through the fastener apertures 20 in the foot 12 of the base 10 of the perimeter clip 6. In some embodiments fasteners, such as threaded self-drilling screws extend through the aligned apertures 20 in the foot 12 of the perimeter clip 6 into the support member 102. The fasteners secure the perimeter clip 6 to the support member 102 (e.g., purlin, joist, or other like member). In other embodiments of the invention the perimeter clip 6 may be operatively coupled to the support member 102 of the roofing decking system 100 in other ways, such as but not limited to other couplings, such as fasteners (e.g., rivets, or the like), welds, or the like. As illustrated by FIG. 29*a*, the support member 102 (e.g., purlin, joist, or the like) supports the insulation 104 between the purlin 102 and the roof panels 106, 108. At least one of the base insulation tabs 52 (if included on the base 10) may be inserted into the insulation 104, or surround the insulation 104, in order to help secure the insulation 104 and prevent it from moving within the decking system 100. The perimeter connector clip 164 is placed over the first decking panel 106 male edge 210 such that male edge 210 is located within the cavity 190 of the perimeter connector 160. Specifically, the corner of the male third leg 216 and the male second leg 214 is located within the connector second cavity 194, and the corner of the male first leg 212 and the male second leg 214 is located within the connector first cavity 192.

The assembly device 44 is located in the base assembly aperture 46 of the base 10 of the perimeter clip 6, and the connector assembly aperture 169 of the connector 160 of the perimeter clip 6 to prevent movement of the connector 160 with respect to the base 10 during installation of the decking system 200.

Figure 29B:
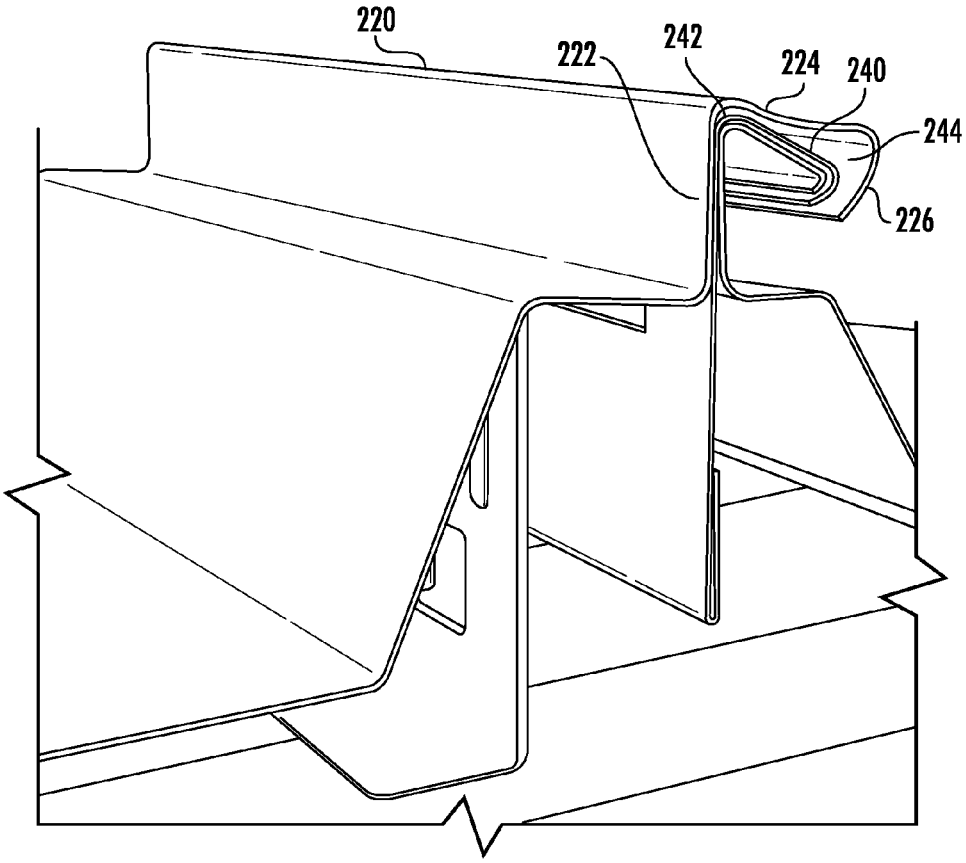
FIG. 29*b* illustrates a perspective view of the perimeter clip of FIG. 26 operatively coupled to two panels, in accordance with embodiments of the present disclosure.

FIG. 29*b* illustrates that a second decking panel 108 is operatively coupled to the support member 102 and/or additional insulation 104, such that the insulation 104 is located between the support member 102 and the second decking panel 108. The second decking panel 108 may have any type of profile that can be utilized with the perimeter clips 6 of the present invention. For example, in the illustrated embodiment in FIG. 29*b* the second decking panel 108 may have a female edge 220 with a female first leg 222 that extends in a generally vertical upward direction (e.g., the x-z plane), such as approximately 90 degrees from a horizontal plane (e.g., the x-y plane) of the second decking panel 108, or in other embodiments between 60 to 120 degrees, or another value or range of values within, outside, or overlapping this range). A female second leg 224 extends outwardly and downwardly from the female first leg 222 away from the second decking panel 108, such as at an angle of 30 degrees from a horizontal plane (e.g., the x-y plane) of the second decking panel 108, or in other embodiments between 10 and 60 degrees, or another value or range of values within, outside, or overlapping this range. A female third leg 226 extends inwardly towards the first female leg 222 at an angle from the second female leg 224 of approximately 45 degrees, such as at an angle that ranges from 20 to 70 degrees, or another value that is within, overlaps, or is outside of this range. In some embodiments (not illustrated), a u-shaped female leg extends from the female third leg 226, and a female fifth leg extends from the female u-shaped leg to form a hook. The female fifth leg may be bent in an orientation that is generally parallel to the female third leg 226. As explained in further detail later the female edge 220 of the second panel 108 is configured to fit over the perimeter connector 160. Moreover, the first decking panel 106 may include additional bends in the panel in order to connect the male edge 210 of the first decking panel 106 with a trough 107 of the first decking panel 106.

The legs of the female edge 220 form a general female cavity 240 within the female edge 220, which may include a female first cavity 242 between the female first leg 222 and the female second leg 224, and a female second cavity 244 between the female second leg 224 and the female third leg 226. As illustrated by FIGS. 29*a* and 20*b*, the connector clip 160 is located within the general female cavity 240. Specifically, the corner of the connector third leg 176 and the connector second leg 174 is located within the female second cavity 244, and the corner of the connector first leg 172 and the connector second leg 174 is located within the female first cavity 242.

Regardless of the type of clip 2, 6 utilized, the seam between the first decking panel 106 and the second decking panel 108, which may or may not include the connectors 30, 60, 160 of the clips 2, 6, may be operatively coupled together manually, or automatically using a machine, for example by bending, crimping, and/or folding the female edge 120, 220 male edge 110, 210 and connector clip 64, 164 to create the locking means in the seam.

Different decking systems 100, 200 may utilize different types of panel clips 2 and/or perimeter clips 6. In some decking systems 100, 200 perimeter clips 6 are utilized at the edges or corners of the roof decking system 100, 200 when potential wind loading or other loading exceeds the panel capacity for standard support member 102 spacing (e.g., purlin spacing, joist spacing, or the like). In some embodiments the perimeter clips 6 may also be utilized in other areas of the decking system 100, 200 at which there are some strong uplift winds and/or where additional strength is needed. The width of the perimeter clips 6 described herein may be 8, 12, and 16 inches (or other widths) and may be determined based on the engineering requirements for the particular application in which the perimeter clips 6 are to be utilized. However, the perimeter clips 6 may be narrowed to a single type, for example, with a width of 12 inches, which may be utilized anywhere in the decking system 100 and provide the desired strength of the decking system 100, 200 while providing a uniform perimeter clip 6 to reduce costs and improve instillation.

Figure 30:
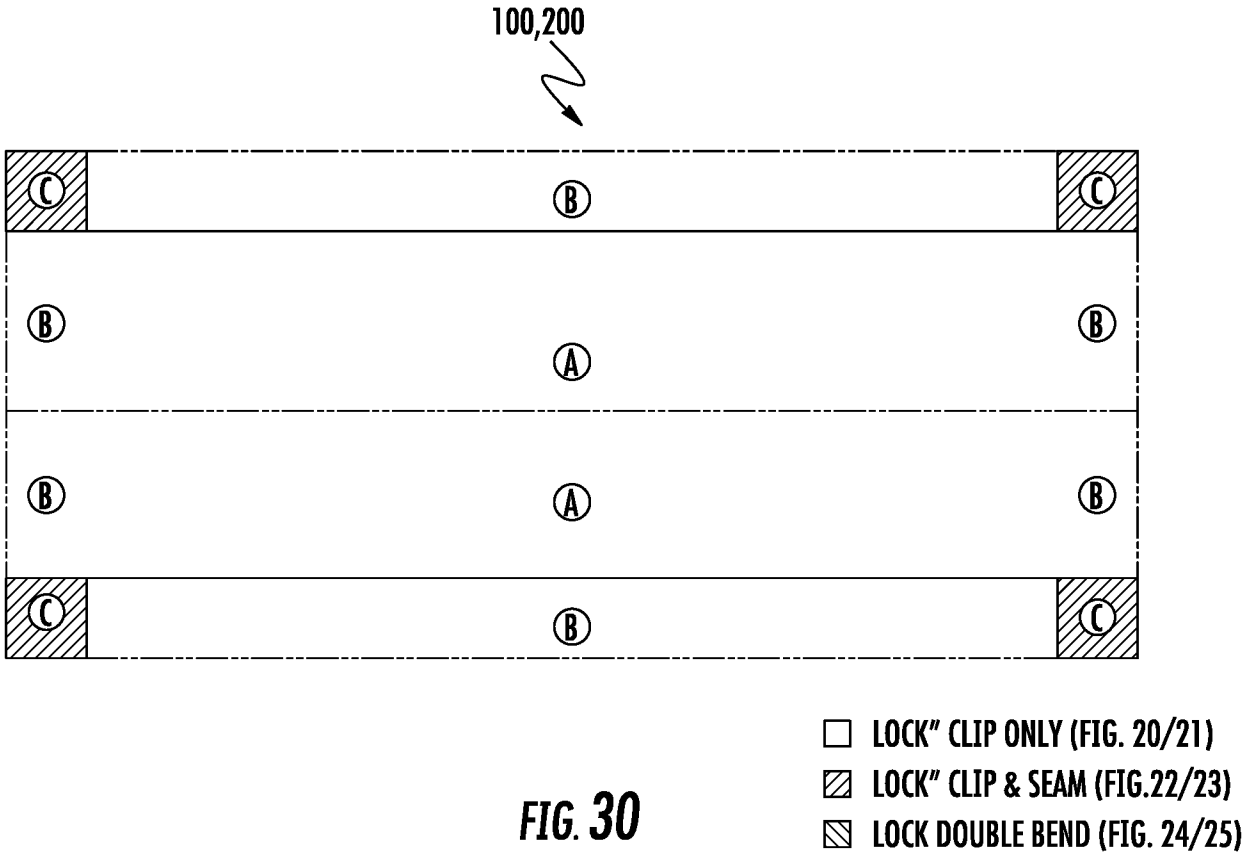
FIG. 30 illustrates a top view of a roof decking system with various zones for utilizing the panel clips and perimeter clips on the decking panels located within the various zones of the roof decking system.

As illustrated in the example decking system 100, 200 of FIG. 30, different zones may require different types of clips and/or different types of seams to create a zoned roofing system that has a zoned clip system and/or a zoned seam system. With respect to the zoned clip system, zone C at the corner of the roof (e.g., two edges of the roof) and/or zone B may require the perimeter clips 6 discussed herein. Moreover, a different number of fasteners may be utilize to couple the perimeter clip 6 to the support member 102 depending on the type of support member 102. For example, if the perimeter clip 6 is operatively coupled to a joist, two fasteners (e.g., in any combination of the five apertures 20) may be utilized, while if the perimeter clip 6 is operatively coupled to a purlin three fasteners may be utilized (e.g., in any combination of the five apertures 20, in the center aperture 20 and any of the other apertures 20). Alternatively, zone B at the edges of the roof may only require the use of the panel clips 2, but a specific number of fasteners (e.g., 3 fasteners) may be required for use in operatively coupling the foot 12 of the base 10 to the associated support member 102. Alternatively, zone A at the center of the roof may also require use of the panel clips 2, but a specific number of fasteners (e.g., 2 fasteners) may be required for use in operatively coupling the foot 12 of the base 10 to the associated support member 102. In still other embodiments of the invention the perimeter clip 6 may be used in zones A, B, and C with any combination of one or more fasteners.

FIG. 30 further illustrates that different types of locking means may be utilized on the seams within the decking system 100. For example, in the illustrated embodiment in FIG. 30, the locking means in which only the portion of the seam with the connector is bent (as illustrated and described with respect to FIGS. 20 and 21) may be utilized in zones A and/or B. Moreover, the locking system in which the seam and the connector, and the seam locations without the connector (as illustrated and described with respect to FIGS. 22 and 23), are crimped and bent may be utilized in zone C and/or B. In order to provide additional strength at different locations of the roof decking system 100 the locking means in which the connector and/or seam is bent over twice in a double bend (as illustrated and described with respect to FIGS. 24 and 25) may be utilized in different areas of the seam. For example, in some embodiments the double bend (FIGS. 24 and 25) may be used in zone C, while the single bend (FIGS. 22 and 23) may be used in zone B. Alternatively, the double bend (as illustrated in FIGS. 24 and 25) may be utilized around the perimeter of the roof, while the single bend (as illustrated in FIGS. 22 and 23) is used in zone C, and the bend at the clip only (as illustrated in FIGS. 20 and 21) is used in zones B and A. In other embodiments of the invention, all of the seams within the decking system may be seamed in the same way. It should be understood that any type of zoned clip system and/or zoned seam system may be utilized to provide the desired strength of the overall roof systems 100, 200. However, as a general matter the perimeter clips 6 and stronger seams (e.g., more bends), are located at the edges, and more particularly at the corners, because of the strong wind loading at the edges and corners.

It should be understood that the improved panel and perimeter clips 2, 6 provide improved roof decking systems 100, 200, including improved sliding and/or improved strength. For example, sliding in the horizontal direction (otherwise described as in the lateral or in-plane direction with respect to the plane of the decking panels and/or clips) is improved to allow for thermal expansion and/or contraction during cyclic heating and cooling of the roof decking system. As such, in some embodiments, when not loaded in the moveable position sliding of the connectors 30, 60, 160 with respect to the bases 10 of the clips 2, 6 may occur after 3, 4, 5, 6, 7, 8, 9, 10, 11, 12, 13, 14, 15, 17, 20, 25, 30, 35, 40, 45, 50, or more lbs. of force, or a range of forces between, outside, or overlapping any of these vales. Additionally, the panel clips 2 and/or perimeter clips 6 provide improved strength in order to prevent damage to the clips when subjected to cyclic loading, wind forces, and/or other forces in part due to the hem 38 of the connectors, the connector ribs 31, and/or base ribs 54 included in the clips 2, 6. As such, not only do the current clips provide improve sliding during cyclic heating and cooling of the roof decking systems 100, 200, but the strength of the clips are at least the same or improved over traditional types of clips when subjected loading, such as wind loading or other types of loading.

Moreover, by utilizing the perimeter clips 6 with the connectors 60 having greater widths than traditional clips, additional purlin or joist runs within the roof decking system are not necessary, and thus costs (e.g., material, labor for installation, or the like) of using and/or assembling purlins or joists may be reduced.

It should be understood that "operatively coupled," when used herein, means that the components may be formed integrally with each other, or may be formed separately and coupled together. Furthermore, "operatively coupled" means that the components may be formed directly to each other, or to each other with one or more components located between the components that are operatively coupled together. Furthermore, "operatively coupled" may mean that the components are detachable from each other, or that they are permanently coupled together.

Also, it should be understood with respect to all of the values and ranges discussed herein that these values and ranges are provided as examples, and other values or ranges of values may be within, outside, or overlapping the values and ranges discussed herein.

Also, it will be understood that, where possible, any of the advantages, features, functions, devices, and/or operational aspects of any of the embodiments of the present invention described and/or contemplated herein may be included in any of the other embodiments of the present invention described and/or contemplated herein, and/or vice versa. In addition, where possible, any terms expressed in the singular form herein are meant to also include the plural form and/or vice versa, unless explicitly stated otherwise. Accordingly, the terms "a" and/or "an" may mean "one or more."

While certain exemplary embodiments have been described and shown in the accompanying drawings, it is to be understood that such embodiments are merely illustrative of and not restrictive on the broad invention, and that this invention is not limited to the specific constructions and arrangements shown and described, since various other changes, combinations, omissions, modifications and substitutions, in addition to those set forth in the above paragraphs, are possible. Those skilled in the art will appreciate that various adaptations, modifications, and combinations of the just described embodiments can be configured without departing from the scope and spirit of the invention. Therefore, it is to be understood that, within the scope of the appended claims, the invention may be practiced other than as specifically described herein.

What is claimed is:

1. A decking system with panel clips and perimeter clips, the decking system comprising:

one or more support members;

a plurality of decking panels operatively coupled to the one or more support members, wherein each of the plurality of decking panels comprise a male edge and a female edge opposite of the male edge;

a plurality of panel clips operatively coupled to the one or more support members, wherein each of the plurality of panel clips comprise:

a panel base comprising a panel base slot;

at least two panel clip fasteners;

a panel connector operatively coupled to the panel base through the at least two panel clip fasteners and the panel base slot, wherein the panel connector has a panel connector width;

wherein a panel clip is operatively coupled with the male edge and the female edge of two of the plurality of decking panels; and wherein the panel connector is configured to slide with respect to the panel base as the at least two panel clip fasteners slide within the panel base slot; and a plurality of perimeter clips operatively coupled to the one or more support members, wherein the plurality of perimeter clips are different than the plurality of panel clips, and wherein each of the plurality of perimeter clips comprise:

a perimeter base comprising a perimeter base slot;

at least two perimeter clip fasteners;

a perimeter connector operatively coupled to the perimeter base through the at least two perimeter clip fasteners and the perimeter base slot, wherein the perimeter connector has a perimeter connector width that is greater than the panel connector width; and wherein the perimeter connector is operatively coupled with the male edge and the female edge of two of the plurality of decking panels; and wherein the perimeter connector is configured to slide with respect to the perimeter base within the perimeter base slot.

2. The decking system of claim 1, wherein each of the plurality of panel clips further comprise:

first and second panel base tabs operatively coupled to the panel base;

a panel plate within the panel connector, wherein the panel plate comprises a plate width portion, wherein the plate width portion is less than the panel connector width, and wherein the panel connector is configured to slide with respect to the panel base until the panel plate is stopped when the plate width portion of the panel plate is stopped by the first panel base tab or the second panel base tab.

3. The decking system of claim 1, wherein each of the plurality of perimeter clips further comprise:

first and second perimeter base tabs operatively coupled to the perimeter base;

a perimeter plate comprising a first perimeter plate slot and a second perimeter plate slot, wherein the first perimeter base tab is located within the first perimeter plate slot and the second perimeter base tab is located within the second perimeter plate slot; and wherein the perimeter connector is configured to slide with respect to the perimeter base as the at least two perimeter clip fasteners slide within the perimeter base slot until the perimeter plate is stopped when at least one of the first perimeter base tab no longer slides within the first perimeter plate slot, or the second perimeter base tab no longer slides within the second perimeter plate slot.

4. The decking system of claim 1, wherein the plurality of panel clips further comprise a panel clip centering device operatively coupling the panel base to the panel connector during installation, and wherein the panel clip centering device is configured to break during thermal cycling of the decking system to allow the panel connector to slide with respect to the panel base; and wherein the plurality of perimeter clips further comprise a perimeter clip centering device operatively coupling the perimeter base to the perimeter connector during installation, and wherein the perimeter clip centering device is configured to break during thermal cycling of the decking system to allow the perimeter connector to slide with respect to the perimeter base.

5. The decking system of claim 1, wherein each of the plurality of panel clips and the plurality of perimeter clips comprise a plate reinforcing portion comprising a portion of a plate folded back on the plate to improve the stiffness of the plate.

6. The decking system of claim 1, wherein the panel base is the same as the perimeter base.

7. The decking system of claim 6, wherein the panel base and the perimeter base comprise ribs to improve the strength of the panel base and the perimeter base.

8. The decking system of claim 1, wherein the panel connector comprises at least one connector rib to improve the strength of the panel connector.

9. A perimeter clip for use in a decking system, the perimeter clip comprising:

a perimeter base comprising a perimeter base slot, and a first perimeter base tab and a second perimeter base tab, wherein the first perimeter base tab and the second perimeter base tab are operatively coupled to the perimeter base;

at least two perimeter base fasteners;

a perimeter connector operatively coupled to the perimeter base through the at least two perimeter base fasteners and the perimeter base slot, wherein the perimeter connector comprises a perimeter plate, and a first perimeter plate slot and a second perimeter plate slot, wherein the perimeter plate has a perimeter plate width that is greater than a perimeter base width;

wherein the first perimeter base tab is located within the first perimeter plate slot and the second perimeter base tab is located within the second perimeter base tab;

wherein the perimeter clip is configured to be operatively coupled with a male edge and a female edge of two adjacent decking panels; and wherein the perimeter connector is configured to slide with respect to the perimeter base as the at least two perimeter base fasteners slide within the perimeter base slot, the first perimeter base tab slides within the first perimeter plate slot, and the second perimeter base tab slides within the second perimeter base tab.

10. The perimeter clip of claim 9, wherein the perimeter connector is configured to slide with respect to the perimeter base until the perimeter plate is stopped when at least one of the first perimeter base tab no longer slides within the first perimeter plate slot, or the second perimeter base tab no longer slides within the second perimeter plate slot.

11. The perimeter clip of claim 9, further comprising:

a perimeter centering device operatively coupling the perimeter base to the perimeter connector, wherein the perimeter centering device prevents the perimeter connector from sliding with respect to the perimeter base during installation, and wherein the perimeter centering device is configured to break during thermal cycling of the decking system to allow the perimeter connector to slide with respect to the perimeter base.

12. The perimeter clip of claim 9, wherein the perimeter plate of the perimeter connector of the perimeter clip comprises a plate reinforcing portion comprising a portion of the perimeter plate folded back on the perimeter plate to improve the stiffness of the perimeter connector.

13. The perimeter clip of claim 9, wherein the perimeter base comprises at least one rib to improve the strength of the perimeter base.

14. The perimeter clip of claim 9, wherein the perimeter base comprises at least one insulation tab for operatively coupling the perimeter base to insulation within the decking system.

* * * * *